US005705328A

United States Patent [19]

Shiozaki

[11] Patent Number: 5,705,328

[45] Date of Patent: Jan. 6, 1998

[54] SILVER HALIDE PHOTOGRAPHIC LIGHT-SENSITIVE MATERIAL

[75] Inventor: Shigeru Shiozaki, Hino, Japan

[73] Assignee: Konica Corporation, Japan

[21] Appl. No.: 701,357

[22] Filed: Aug. 22, 1996

[30] Foreign Application Priority Data

Aug. 30, 1995 [JP] Japan ..... 7-221999
Sep. 22, 1995 [JP] Japan ..... 7-244553

[51] Int. Cl.[6] ..... G03C 1/76

[52] U.S. Cl. ..... 430/531; 430/523; 430/539; 430/502

[58] Field of Search ..... 430/502, 523, 430/531, 539

[56] References Cited

U.S. PATENT DOCUMENTS 3,639,332 2/1972 Coover, Jr. et al. ..... 524/577
5,188,930 2/1993 Funaki et al. ..... 430/531
5,472,831 12/1995 Nishiura et al. ..... 430/523
5,558,979 9/1996 Ishigaki et al. ..... 430/531

FOREIGN PATENT DOCUMENTS

0706082A1 10/1996 European Pat. Off. .

*Primary Examiner*—Geraldine Letscher
*Attorney, Agent, or Firm*—Jordan B. Bierman; Bierman, Muserlian and Lucas LLP

[57] ABSTRACT

A silver halide photographic light sensitive material comprises a support and provided thereon, a silver halide emulsion layer, the support comprising a syndiotactic polystyrene, wherein the support has a temperature expansion coefficient of not more than $50\times10^{-6}$/°C. and a humidity expansion coefficient of not more than $15\times10^{-6}$/% RH.

13 Claims, No Drawings

SILVER HALIDE PHOTOGRAPHIC LIGHT-SENSITIVE MATERIAL

INDUSTRIAL FIELD OF THE INVENTION

The present invention relates to a silver halide photographic light sensitive material comprising a support comprised of a biaxially oriented syndiotactic polystyrene, and especially to a silver halide photographic light sensitive material comprising a support comprised of a biaxially oriented syndiotactic polystyrene having a small temperature expansion coefficient and a small humidity expansion coefficient and having excellent dimensional stability.

BACKGROUND OF THE INVENTION

As a support of a silver halide photographic light sensitive material for graphic arts (hereinafter also referred to a light sensitive material for graphic arts), polyethylene terephthalate (hereinafter also referred to PET) is used. Cellulose triacetate has been so far used as a photographic support, but it has a large hygroscopic property, a large water absorption and a small modulus of elasticity, resulting in poor dimensional stability as a light sensitive material for graphic arts. Therefore, PET, which has more excellent properties, has been employed for a photographic support.

The dimensional stability of a silver halide photographic light sensitive material for graphic arts is one of the most important properties, since it is required to obtain printing matter without color image doubling in printing using four color separation light sensitive materials. The dimensional stability depends largely on a thickness of a photographic support or a light sensitive layer (referred to the entire layer including an emulsion layer, an intermediate layer, a protective layer, a backing layer and the like), modulus of elasticity, hygroscopic expansion coefficient (hereinafter referred to also as ($\alpha_h$)) or thermal expansion coefficient (hereinafter referred to also as ($\alpha_t$)). This is apparent from an equation regarding dimensional stability of silver halide photographic light sensitive material described in J. Q. Umberger, Phot. Sci. Eng. Volume 11, p. 385 (1967). Four light sensitive materials were photographically processed under the same temperature and humidity to obtain four color separation film originals for color printing. When one of the four originals is again prepared, processing can not be carried out under the same conditions as before, resulting in a dimensional slight difference from the other three originals. In such a case, four originals must be prepared once again, resulting in waste of cost and labor. In view of the above, a light sensitive material capable of securing dimensional stability under different conditions has been sought. In order to obtain such a material, a PET support is used at the present as a cheap photographic support which has a small water absorption and a relatively low ($\alpha_h$). Regarding a light sensitive layer are used methods of reducing modulus of elasticity by reducing the light sensitive layer thickness or by adding a polymer latex to the light sensitive layer.

A photographic layer such as a light sensitive layer in a silver halide photographic light sensitive material for graphic arts had a great influence on its dimensional stability. Recently, it is possible to make the photographic layer thinner, and the layer has contributed little to the dimensional stability. So, an influence of a photographic PET support itself on dimensional stability has been a problem.

In order to reduce ($\alpha_h$) of the light sensitive material for graphic arts by decreasing a water absorption of the PET support, a method of coating a vinylidene chloride resin on the support is used. However, the method has a problem in that when waste materials was burned in a furnace for discarding, a hydrogen chloride gas produces, resulting in damage of the furnace or environmental pollution. Therefore, this method is not preferable, and another photographic support having ($\alpha_h$) lower than that of a PET support has been sought.

SUMMARY OF THE INVENTION

An object of the present invention is to provide a silver halide photographic light sensitive material having excellent dimensional stability, and especially to a silver halide photographic light sensitive material excellent in dimensional stability comprising a support comprised of a biaxially oriented syndiotactic polystyrene having a small thermal expansion coefficient and a small hygroscopic expansion coefficient.

DETAILED DESCRIPTION OF THE INVENTION

A photographic support, with which PET is replaced, has been sought, and it has been found that a syndiotactic polystyrene (hereinafter referred to also SPS) is suitable for a PET alternative, since its ($\alpha_h$) is low. Various usages of a SPS film are proposed, since SPS is highly transparent, low in ($\alpha_h$), light, and high in mechanical strength.

The present invention can be attained by a silver halide photographic light sensitive material comprising a support comprised of a biaxially oriented syndiotactic polystyrene having ($\alpha_t$) of not more than $50\times10^{-6}$/°C. and ($\alpha_h$) of not more than $15\times10^{-6}$/% RH.

The ($\alpha_h$) and ($\alpha_t$) are determined depending on material. The ($\alpha_h$) of a SPS photographic support is in the order of approximately $1\times10^{-6}$/% RH, and that of PET is in the order of approximately $2\times10^{-5}$/% RH, and the ($\alpha_h$) of a SPS photographic support is 1/20 to 1/50 times lower than that of PET. The ($\alpha_h$) of a layer comprising gelatin such as a light sensitive emulsion layer is about $10\times10^{-5}$ to $30\times10^{-5}$/(% RH), although different depending on the composition. Accordingly, ($\alpha_h$) of a SPS photographic support is so low that it cannot influence the ($\alpha_h$) of the silver halide photographic light sensitive material, even if effect of the thickness of the light sensitive layer (for example, a thickness ratio of the light sensitive layer to the support of 1/10) is considered. That is, even if the thickness of the total layers comprising a light sensitive layer is considerably small, ($\alpha_h$) of a SPS photographic support is not considered to influence the ($\alpha_h$) of the silver halide photographic light sensitive material. If the SPS photographic support thickness is less, its influence on silver halide photographic light sensitive material is considered to be further less.

The ($\alpha_t$) of a SPS film is substantially the same as that of PET and in the order of approximately $20\times10^{-6}$/°C. If this ($\alpha_t$) value can be reduced more, the dimensional variation on temperature of a silver halide photographic light sensitive material can be reduced. The reduction of $\alpha_t$) contributes much to dimensional stability.

The present inventors have extensively studied film manufacturing conditions reducing ($\alpha_h$) and ($\alpha_t$), and found that they vary depending on orientation.

The present inventors have further found that there is a linear relationship between the refractive index and the both expansion coefficients. The reason why the expansion coefficients have such a relationship is not definite, however, it is considered that there is any relationship between an orientation structure of a syndiotactic polystyrene and its expansion coefficient.

The present invention will be detailed below.

The SPS in the invention will be explained below. The SPS in the invention, that is, a polystyrene having a syndiotactic structure, means one having a stereo regularity, a syndiotactic structure, in which phenyl groups or substituted phenyl groups as a side chain are alternatively positioned on opposite sides to the polystyrene main chain. However, in the SPS, all the chemical structure do not necessarily have a syndiotactic structure, but SPS have, in the polymer, such a chain structure that several syndiotactic structures are connected, overlap to form a crystal structure. This chain is called a racemo chain, and SPS has many recemo chains in the polystyrene structure. In the successive plural styrene units, two successive units are called a diad, three successive units are called a triad, and five successive units are called a pentad. The polystyrene having a syndiotactic structure in the invention has ordinarily not less than 75%, preferably not less than 85% of a recemi diad, or not less than 60%, preferably not less than 75% of a recemi triad, or not less than 30%, preferably not less than 50% of a recemi pentad. This tacticity is measured according to a nuclear magnetic resonance method using a carbon thirteen ($^{13}$C-NMR method).

The SPS in the invention may be a styrene homopolymer or a styrene copolymer containing a styrene derivative or another monomer unit. The styrene homopolymer can be synthesized by polymerization disclosed in Japanese Patent O.P.I. Publication No. 62-117708/1987, and another styrene copolymer can be synthesized by polymerization disclosed in Japanese Patent O.P.I. Publication Nos. 1-46912/1989 and 1-178505/1989.

The monomer capable of forming the styrene copolymer includes styrene, an alkyl styrene such as methyl styrene, a halogenated (halogenated alkyl) styrene such as chlorostyrene, chloromethylstyrene and an alkoxy styrene.

When the SPS photographic support in the invention is composed of a polymer containing a styrene derivative other than styrene, it contains the derivative in an amount of not more than 15%, preferably not more than 10%, and more preferably 5 to 10%. The styrene derivative is preferably 4-methylstyrene.

The polystyrene in the invention having a syndiotactic structure can be obtained by polymerizing the above monomer in the presence of a catalyst such as a composition containing a transition metal compound and aluminoxane or a composition containing a transition metal compound and a compound capable of forming an ionic complex on reaction with the transition metal compound disclosed in Japanese Patent O.P.I. Publication No. 5-320448/1993, p. 4 to 10.

In order to manufacture the styrene polymer for the SPS photographic support used in the invention, a purified styrene monomer is polymerized in the presence of the above described catalyst. The polymerization method, polymerization conditions (polymerization temperature, polymerization time), a solvent for polymerization may be appropriately selected. Ordinarily polymerization is carried out at −50° to 200° C., preferably 30° to 100° C., for 1 second to 10 hours, preferably 1 minute to 6 hours. The polymerization method includes a slurry polymerization, a solution polymerization, a bulk polymerization, and an air polymerization, and may be a continuous or discontinuous polymerization. The polymerization solvent includes an aromatic hydrocarbon such as benzene, toluene, xylene or ethylbenzene, an aliphatic hydrocarbon such as cyclopentane, hexane, heptane, octane or their combination. The ratio, monomer/solvent (by volume) can be arbitrarily selected. The control of the molecular weight or composition of a polymer obtained can be conducted according to a conventional method. The molecular weight can be controlled by addition of hydrogen, polymerization temperature or a monomer concentration. After polymerization, the polymer is preferably made into pellets.

SPS has high crystallinity, and the surface activity (adhesion property) of a SPS support is not sufficient. Therefore, in order to improve the adhesion property, the support preferably contains an unpolymerized monomer such as a styrene monomer in an amount of not more than 0.05 weight %, 5, preferably not more than 0.01 weight % based on the support weight. The removing of the unpolymerized monomer is carried out by evaporation in a fusible state under reduced pressure after polymerization. The unpolymerized monomer is measured by a GPC method using 1,2,4-trichlorobenzene at 135° C.

The molecular weight of the SPS polymer used in the photographic support in the invention is not limited, as long as it can form a film, but the weight average molecular weight of the polymer is preferably 10,000 to 3,000,000, and especially preferably 30,000 to 1,500,000. The molecular weight distribution (weight average molecular weight/number average molecular weight) is preferably 1.5 to 8. The molecular weight distribution is preferably 2.5 to 4 in view of no precipitation or no striation of support. The molecular weight distribution can be adjusted also by mixing polymers having a different molecular weight.

3. The average molecular weight is 350,000 or more, and preferably 450,000 to 1,500,000 in view of tear transmission resistance.

In the SPS photographic support in the invention, an SPS homopolymer is preferable in view of stereoregularity. The homopolymer may be blended with a styrene polymer having an isotactic structure (IPS) in which the main chain is a meso chain, and the crystallization speed in this polymer can be controlled, whereby a film having more mechanical strength can be obtained. When SPS is mixed with IPS, the mixture ratio, SPS:IPS (mole ratio) is preferably 30:70 to 99:1, more preferably 50:50 to 98:2, although depending on stereoregularity of each polymer.

In the SPS photographic support used in the invention, the SPS pellets may contain inorganic fine particles, antioxidants, UV absorbers, antistatic agents, colorants, pigment or dyes, as long as an object of the invention is not jeopardized.

The SPS polymer pellets in the present invention is preferably dried at a temperature of 120° to 180° C. for 1 to 24 hours under vacuum pressure or under ordinary pressure of inactive gas surroundings such as air or nitrogen gas.

The film manufacturing method for the SPS photographic support used in the invention will be explained below. For the extruding method at the time of manufacturing the film, any conventional method may be applied. For example, a extrusion method by the use of a T-die is preferable. The vacuum dried SPS pellets are melted and extruded at a temperature of 280° to 350° C., and cooled and solidified on a casting roll while applying electrostatic potential to obtain an unoriented film.

Next, this unoriented film is oriented biaxially. For the method of orientation, any appropriate method from a variety of known methods, for example, including one after another biaxial orientation method in which a longitudinal orientation and a lateral orientation are carried out in this order, another one after another biaxial orientation method in which a lateral orientation and a longitudinal orientation are carried out in this order, a lateral-longitudinal-lateral orientation method, a longitudinal-lateral-longitudinal orientation method, a longitudinal-longitudinal-lateral orientation method or simultaneous biaxial orientation method may optionally be selected. In the invention, a method in which a longitudinal orientation (mechanical direction) and a lateral orientation (transverse direction) are carried out in this order or a longitudinal-lateral-longitudinal orientation method is preferable.

($\alpha_h$) and ($\alpha_t$) in the invention can be within the range of the invention depending on the orientation conditions as described above. In order to attain ($\alpha_h$) and ($\alpha_t$) in the invention, the unoriented film is obtained by longitudinally orienting at a draw ratio of 2 to 6 times, preferably 3.5 to 5 times at a temperature of from a glass transition temperature (Tg) plus 10° C. to a glass transition temperature (Tg) plus 50° C., and then by laterally orienting at a draw ratio of 2 to 6 times, preferably 3.5 to 5 times at a temperature of a glass transition temperature (Tg) plus 15° C. to a glass transition temperature (Tg) plus 60° C.

In the SPS film, the strength or modulus of elasticity in an orientation direction after first orientation is in proportion to the orientation magnification, and the mechanical strength or modulus of elasticity after first orientation is likely to be lowered after orienting the resulting film in a direction perpendicular to the first orientation in a direction parallel to the plane. In order to overcome this lowering, for example, the film is firstly oriented by 2.7 to 5 times length and then secondly oriented by 1.2 to 4.5 times length, in which the first orientation temperature is selected to obtain an refractive index of 1.597 or more in a direction perpendicular to the first orientation and the second orientation temperature is 70° to less than 105° C., and finally heat set. The first drawing temperature is preferably selected to obtain an refractive index of 1.597 to 1.625. In this method, there is no problem of film breakage in the manufacturing process.

The oriented film is heat set. Attaining the object of the invention depends on the film manufacturing conditions, but heat set treatment is one of important conditions. The heat set temperature is 170° to 270° C., preferably 220° to 270° C., more preferably 230° to 260° C. The heat set time is not specifically limited, but is ordinarily 3 to 100 seconds. At heat set treatment, heat relaxation treatment may be optionally carried out for 3 to 100 seconds.

As the draw ratio is increased within the above range, refractive index is less, and when heat set treatment is further carried out at 230° to 255° C., refractive index is further less. There is a linear relation between the refractive index and ($\alpha_h$) or $\alpha_t$) that as the refractive index is less, both ($\alpha_h$) and $\alpha_t$) are less.

In cases of manufacturing a support, the film in the form of sheet is sheared. The serration of the shearing section not only lose commercial value of a silver halide photographic light sensitive material but also produces fine debris which causes a problem such as coating fault or an image defect due to its adherence to the support or the light sensitive material. In order to solve the problem, it is preferable that the refractive index (in all plane directions) is 1.585 or less, and the refractive index in the longitudinally or laterally direction is 1.585 or less, and preferably 1.57 or less. The above problem is likely to be solved by the refractive index in the thickness direction of 1.625 or less, preferably 1.622 or less. The lower limit of the indexes is preferably 1.54 in the longitudinally or laterally direction, and 1.61 in the thickness direction. This range of the above indexes is obtained by controlling orientation temperature, orientation magnification, a balance of longitudinal and lateral orientation magnifications, heat set temperature or heat set time. In the longitudinally and laterally oriented support, an index difference between the refaractive indexes of the obverse and reverse surface in the thickness direction is $4\times10^{-3}$ or less, preferably $2\times10^{-3}$ or less, and more preferably close to zero. This support having such a characteristics has excellent flatness and anti-curling property, maintaining SPS properties (thermal, mechanical, chemical properties and dimensional stability). A conventional method is used in order to obtain no index difference, for example, a method in which there is no temperature difference or no cooling speed difference between the obverse and reverse surface in the manufacturing steps comprising extrusion, longitudinal and laterl orientation, and heat set.

The density of the support in the invention is 1.05 g/cm$^2$or less, and preferably 1.0 to 1.04 g/cm$^2$. The refractive index useful for the invention is 1.585 or less, and the lower limit is preferably 1.540, although not restricted. It has been found that when heat set is not carried out or is carried out at lower temperature in the same draw ratio condition, refractive index is larger, and therefore, ($\alpha_t$) is larger. The ($\alpha_h$) of the SPS photographic support in the invention is not more than 15×10–6/(% RH), preferably not more than $1.0\times10^{-6}$/(% RH) and the lower limit is $0.1\times10^{-6}$/(% RH), and preferably $0.2\times10^{-6}$/(% RH).

The lower limit of ($\alpha_t$) is preferably $20\times10^{-5}$/° C., although not restricted.

The refractive index, ($\alpha_h$) or ($\alpha_t$) referred to in the invention is a value in the plane of the support, and preferably shows the same value in all plane directions. The film manufacturing is controlled to obtain such a value. When the value is largely different in longitudinal, lateral and 45° directions, registration is difficult.

When ($\alpha_h$) or ($\alpha_t$) is satisfied as described in the claim, the object of the invention can be attained regardless film manufacturing methods.

The thickness of the SPS photographic support is different depending on the usage of a silver halide photographic light sensitive material, and is, for example, 50 to 130 μm in a color film, 70 to 200 μm in a light sensitive material for graphic arts, and around 180 μm in an X-ray film. The thickness of the film manufactured under the above described film manufacturing conditions is preferably 50 to 220 μm.

In the SPS support in the invention, modulus of elasticity in the longitudinal and lateral direction is 460 kgf/mm$^2$ or more, and preferably 475 to 540 kgf/mm$^2$, in view of the mechanical or thermal properties of a light sensitive material. The modulus of elasticity is measured at 23° C. and 55 % RH, using Tensilon RTA-100 produced by Orientic Co., Ltd.

In order to make an easy diagonis of an X-ray film handling, it is effective to enhance stiffness of the support. The support in the invention preferably has a relation, $Et^3\geqq340$, in view of the support stiffness, wherein E represents Young's modulus (kgf/mm$^2$) and T is a thickness of the support. The polymer for a support is manufactured by polymerization in the presence of an aluminium compound as a catalyst. The aluminium content of the support is preferably 0.05 weight % or less, in view of haze reduction or excellent flatness. The center line average roughness ($R_a$) of the support is preferably 0.008 μm or less, and the support haze is preferably 1.2 % or less. The $R_a$ can be controlled by varying a catalyst amount, a draw ratio of the support or heat-set temperature of the support, or adding inactive inorganic compounds such as silica or alumina or varying the size or the added amount of the compounds. The aluminium content is measured by an Inductive Coupled Plasma method, and in order to give an aluminium content of 0.05 weight % or less, a method disclosed in Japanese Patent O.P.I. Publication No. 1-294705/1989 (a polymerization method using an highly active catalyst) or Japanese Patent O.P.I. Publication No. 62-187708/1977 (a method including de-ashing or washing) is used. $R_a$ is measured according to JIS B601. $R_a$ in the invention is an average value of $R_a$'s in the longitudinal and lateral directions. Haze is measured according to ASTM-D1003-52, and is measured by a commercially available meter.

Next, a subbing layer will be described below. Before the subbing layer coating, surface treatment such as chemical treatment, mechanical treatment, corona discharge, flame treatment, ultra-violet-rays treatment, high frequency electromagnetic waves treatment, glow discharge treatment, active plasma treatment, laser treatment, mixed acid treatment or ozone oxidation treatment is preferably carried out. This treatment enables a contact angle of the support surface to water to be not more than 65°, preferably not more than 55°, and not less than 39° as the preferable lower limit, and improves wettability and adhesion property on the subbing layer coating. The contact angle is measured according to JIS K6768.

When the corona discharge treatment is carried out, discharge frequency is preferably 50 to 5000 KHz and, more preferably, 5 to several hundred KHz. If the discharging frequency is too low, stable discharge property may hardly be obtainable. It is also unpreferable that pinholes tend to be occurred on the subject. When, on the other hand, the frequency is too high, a special equipment for adjusting impedance may be required and this is unpreferable because it raises the price of the equipment. As regards treatment strength of the subject, it is 5 to 20 W·min./$m^2$ and preferably 6 to 15 W·min./$m^2$ in the SPS photographic support. The treatment strength is different depending on the kind of equipment (gap-clearance between the electrode, discharge form, discharge frequency or wave shape), but the equipment can be adjusted to obtain a contact angle within the above range of the support surface to water within the above range.

It is preferable that the treatment with ultra-violet ray-irradiation is carried out with a high or low pressure mercury lamp made of quartz tube having a spectral wave length range of 180 to 380 nm. Irradiation of the ultraviolet rays is preferably performed during the film manufacturing steps such as a orientation step and heat set step or after the heat set step, and more preferably at the latter half of the orientation step or during the heat set step. The ultraviolet ray irradiation amount is 100 to 1500 mJ/$cm^2$ with a high pressure mercury lamp having the main wavelength of 365 nm, and is 200 to 1500 mJ/$cm^2$, preferably 400 to 1300 mJ/$cm^2$ with a low pressure mercury lamp having the main irradiation wavelength of 254 nm. The treatment strength depends on the kinds of lamps or apparatus and is not strictly determined, but the apparatus can be adjusted to obtain a contact angle within the above range of the support surface to water within the above range.

Any subbing layer known in the art can be used. The subbing layer can be provided on the SPS photographic support in the invention during the film manufacturing step, that is, a step before orientation, after an uniaxial orientation, after a biaxial orientation and before a heat set or after a biaxial orientation and a heat set in the same manner as in PET. There is no problem of adhesion property in that a subbing layer is provided on the SPS support before completion of orientation crystallization. The subbing layer is dried preferably at 80° to 250° C. The surface treatment such as the above described ultraviolet rays irradiation or corona discharge before or after the subbing layer coating is an effective method enhancing adhesive property of the SPS photographic support.

The compound used in the subbing layer of the SPS photographic support in the invention includes a polymer or copolymer obtained by polymerization of an unsaturated carboxylic acid such as methacrylic acid, acrylic acid, itaconic acid, or maleic acid, an unsaturated carboxylic acid ester comprising alkyl having 1 to 8 carbon atoms, hydroxyethyl, phenyl, benzyl, phenetyl, N,N-dimethylaminoethyl or glycidyl, an N-substituted acryl amide (having alkyl having 1 to 4 carbon atoms, phenyl, sulfopropyl, benzyl, or N-methylol as a substituent), styrene, styrene sulfonic acid, vinylidene chloride, vinyl chloride and butadiene, and includes a water dispersible polyester, polyurethane, polyethyleneimine and epoxy resin. Of these, styrene-butadiene copolymer is preferably used. Concretely, styrene-butadiene copolymer having a mole ratio of styrene to butadiene of 9/1 to 1/9 is preferable. Styrene-butadiene copolymer which contains a third comonomer having a hydrophilic group in an amount of 2 to 10 weight % improves adhesion between a photographic support and a silver halide emulsion layer. Another preferable example includes a copolymer comprising polystyrene and a water dispersible polyester.

The above water dispersible polyester is a substantially linear polymer obtained by polycondensation of a polybasic acid or its ester derivative with a polyol or its ester derivative. The polybasic acid includes terephthalic acid, isophthalic acid, phthalic acid, phthalic anhydride, 2,6-naphthalene dicarboxylic acid, 1,4-cyclohexane dicarboxylic acid, adipic acid, sebatic acid, trimellitic acid, pyromellitic acid, and dimer acid. Besides these, an unsaturated polybasic acid such as maleic acid, fumalic acid or iraconic acid or a hydroxy carboxylic acid such as p-hydroxybenzoic acid or p-(β-hydroxyethoxy)benzoic acid can be used in a small amount.

The polyol includes ethylene glycol, diethylene glycol, 1,4-butane diol, neopentyl glycol, dipropylene glycol, 1,6-hexane diol, 1,4-cyclohexane dimethanol, xylylene glycol, trimethylol propane, poly(ethyleneoxide)glycol, and poly (tetramethyleneoxide)glycol.

In order to give water dispersibility or solubility to the water dispersible polyester, the incoporation of a sulfonic acid, diethylene glycol or polyalkylene-ether glycol in the ester is effective. The water dispesible polyester contains a dicarboxylic acid having a sulfonate salt (a dicarboxylic acid having a sulfonate salt and/or its ester derivative) in an amount of preferably 5–15 mol % based on the total dicarboxylic acid content. The dicarboxylic acid having a sulfonate salt and/or its ester derivative is preferably a dicarboxylic acid having an alkali metal sulfonate salt, for example, an alkali metal salt of 4-sulfoisophthalic acid, 5-sulfoisophthalic acid, sulfoterephthalic acid, 4-sulfophthalic acid, 4-sulfonaphthalene-2,7-dicarboxylic acid or 5-(4-sulfophenoxy) isophthalic acid or its ester derivative. The dicarboxylic acid having a sulfonate salt and/or its ester derivative is especially preferably used in an amount of 6 to 10 mol % based on the total dicarboxylic acid content, in view of water solubility or water resistance.

The copolymer containing the water dispesible polyester and a styrene (vinyl) polymer is obtained by chain transfer polymerization to a water dispesible polyester, copolymerization of a water dispesible polyester having a group capable of addition polymerization with a styrene (vinyl) type monomer, or graft polymerization of a styrene (vinyl) type monomer to a water dispersible polyester having a reactive group such as carboxyl, glycidyl or substituted amino. This styrene type monomer can be changed to another vinyl monomer.

When the vinyl monomer is polymerized in the presence of a water dispersible polyester, latex polymerization is carried out. The polymerization can be carried out without any surfactant. However, in order to stabilize the polymerization, a surfactant such as a nonionic or anionic surfactant may be used as an emulsifying agent.

The weight content ratio (weight ratio) of the water dispersible polyester to the styrene type polymer is 99/1 to 5/95, preferably 97/3 to 50/50, and more preferably 95/5 to 80/20.

The polymerization initiator is used in the polymerization, and the polymerization initiator includes a persulfate such as ammonium persulfate, potassium persulfate or sodium persulfate, a peroxide such as hydrogen peroxide, an azobis compound such as 4,4'-azobis-4-cyanovaleic acid or its salt or 2,2-azobis(2-aminopropane) hydrogen chloride. The peroxide or persulfate can be used as a redox initiator in combination with a reducing agent such as ferrous chloride, ferrous sulfate, antimony sulfate or sodium thiosulfate.

The SPS photographic support in the invention is subcoated using water, a mixture of water and an organic solvent or an organic solvent. The solvent for SPS includes benzene, xylene, toluene, ethylbenzene, cyclopentane, hexane, heptane, octane, methylethyl ketone and cyclohexanone. If these solvents are used in a large amount as a subcoat solvent, the support is damaged, resulting in loss of flatness. Therefore, these solvents are preferably mixed in a small amount in a poor solvent such as methanol, ethanol, propanol, cyclohexanol or acetone. The content of these solvent is preferably 15% or less based on the poor solvent.

A polymer latex, in which water is used as a solvent, is often used for the subbing layer of the SPS photographic support in the invention. The organic solvent such as methanol, ethanol or acetone may be mixed in the polymer latex. The subcoat solution of the SPS photographic support in the invention contains the following water soluble polymer to improve coatability. The useful water soluble polymer includes hydroxyethyl cellulose (HEC), carboxymethyl cellulose (CMC), methyl cellulose (MC), hydroxypropyl cellulose (HPMC), ethylhydroxyethyl cellulose (EHEC), modified hydroxyethyl cellulose (HMHEC), polyvinyl pyrrolidone (PVP), polyethylene oxide (PEO), xanthane, cationic hydroxyethyl cellulose (CATHEC), hydroxypropyl guar (HP guar), quar, polyvinyl alcohol (PVP), polyacryl amide, sodium alginiate, and Carbopol (trade name) acrylamide viscosity increasing agent. The especially preferable water soluble polymer is CMC or MC. For example, CMC-7LX (substitution degree =0.65–0.80, a 5 weight % aqueous solution having a viscosity of 200 to 1000 mPa.s, produced by Aqualon Co., Ltd.) is useful for a subcoat solution of the SPS photographic support, but a solution containing another kind of polymer or a polymer having various viscosities or various substitution degrees of carboxymethyl can be used. MC or HEC (produced by Aqualon Co., Ltd.), EHEC (Berol, produced by Noberol), or HPMC (produced by Doe Chemical Co., Ltd.) is useful for a subcoat solution of the SPS photographic support.

The polymer concentration of the subbing layer coating solution for the SPS photographic support is preferably not more than 20% by weight and more preferably, not more than 15% by weight, in view of uniform coatability.

The coating solution is coated to obtain a dry thickness of 1 to 20 g and preferably, 5 to 15 g per 1 square meter of the film, in view of coatability and adhesion property. The coating amount of the polymer for subbing is coated to obtain a dry thickness of 10 to 300 mg and preferably, 100 to 1000 mg per 1 square meter of the film.

The coating speed of a subbing layer on the support is not less than 80 m/minute, preferably 100 to 145 m/minute.

Incidentally, SPS film has a specific feature that dielectric loss is small. For this reason, it has a characteristic feature that once it is charged, it is hardly discharged naturally. Accordingly, a subbing layer coating condition is changed depending on the electric charge distribution, so that it is tend to occur uneven coating. Therefore, it is preferable to discharge by force before and after coating the subbing layer coating solution. The discharging method includes, for example, a method of grounding rolls being contact with the transporting support, a method of spraying water vaporized by applying ultra-sonic waves, a method of neutralizing electric charge by generating ionized air with radioactive irradiation; a method of using a discharging brush; an applying high voltage method and a bombarding ionized wind method.

The subbing layer may be a single layer, but is preferably a multiple layer in view of improving functionality or adhesion property. The multiple layer will be explained below. Regarding the multiple layer, the above described subbing layer is designated as a lower subbing layer, and the following subbing layer is designated as an upper subbing layer.

The subbing layer coating may be carried out after the above film manufacturing, but if the subbing layer composition can be oriented, the subbing layer coating may be carried out during the film manufacturing step such as a step before a longitudinal orientation, a step between a longitudinal and lateral orientation or a step after the lateral orientation and before a heat set. When the subbing layer composition cannot be oriented, for example, the subbing layer composition contains a polymer having a hydrophilic group, in which the interaction between the hydrophilic groups is too strong to be oriented, orientation can be carried out under a steam atmosphere or employing a subbing layer composition containing an orientation auxiliary.

The upper subbing layer is preferably comprised of a hydrophilic binder layer in order to improve adherence to a photographic emulsion layer. The binder constituting the hydrophilic binder layer polymer includes a water soluble polymer such as gelatin, a gelatin derivative, casein, agar, sodium arginate, starch, polyvinyl alcohol, polyacrylic acid copolymer, carboxymethyl cellulose or hydroxyethyl cellulose and a mixture of polystyrene sodium sulfonate and a hydrophobic latex. Among these the most preferable is gelatin.

The upper subbing layer preferably contains a hardener in order to enhance film strength. The hardener includes an aldehyde compound such as formaldehyde and glutaraldehyde, a reactive halogen-containing compound disclosed in U.S. Pat. Nos. 2,732,303 and 3,288,775 and British Patent Nos. 874,723 and 1,167,207, a ketone compound such as diacetyl or cyclopentanedione, bis(2-chloroethyl)urea, 2-hydroxy-4,6-dichloro-1,3,5-triazine, divinyl sulfone, 5-acetyl-1,3-diacroylhexahydro-1,3,5-triazine, a reactive olefin compound disclosed in U.S. Pat. Nos. 3,232,763 and 3,635,718 and British Patent No. 994, 809, a vinylsulfone compound disclosed in U.S. Pat. Nos. 3,539,644 and 3,642,486, Japanese Patent Publication Nos. 49-13568/1974, 53-47271/1978 and 56-48860/1981, and Japanese Patent O.P.I. Publication Nos. 53-57257/1988, 61-128240/1986, 62-4275/1987, 63-53541/1988 and 63-264572/1988, N-hydroxymethylphthalimide, an N-methylol compound disclosed in U.S. Pat. Nos. 2,732,316 and 2,586,168, an isocyanate compound disclosed in U.S. Pat. No. 3,103,437, an aziridine compound disclosed in U.S. Pat. Nos. 2,983,611 and 3,107,280, an acid derivatives disclosed in U.S. Pat. Nos. 2,729,294 and 2,729,295, a carbodiimide compound disclosed in U.S. Pat. No. 3,100,704, an epoxy compound disclosed in U.S. Pat. No. 3,091,537, an isooxazole compound disclosed in U.S. Pat. Nos. 3,321,313 and 3,543,292, a halogenocarboxyaldehyde such as mucochloric acid, a dioxane derivative such as dihydroxydioxane or dichlorodioxane, and an inorganic hardener such as chrom alum, zirconium sulfate or chromium trichloride. As a hardener relatively rapidly hardening gelatin are known a dihydroquinoline skeleton containing compound disclosed in Japanese Patent O.P.I. Publication No. 50-30504/1075, an N-carbamoylpyridinium salt disclosed in Japanese Patent O.P.I. publication Nos. 51-59625/1976, 62-262854/1987, 62-264044/1987 and 63-184741/1988, an acylimidazole disclosed in Japanese Patent publication No. 55-38655/1980, an N-acyloxyimidazole disclosed in Japanese Patent publication No. 53-22089/1978, a compound having two or more N-acyloxyimino groups disclosed in Japanese Patent publication No. 53-22089/1978, a compound having an N-sulfonyloxyimino group disclosed in Japanese O.P.I. Patent publication No. 52-93470/1977, a compound having a phosphor-halogen bond disclosed in Japanese O.P.I. Patent publication No. 58-113929/1983 and a chloroformamidinium disclosed in Japanese Patent O.P.I. Publication Nos. 60-225148/1985, 61-240236/1986 and 63-41580/1988.

The upper subbing layer preferably contains, as a matting agent, inorganic fine particles such as silica dioxide and titanium dioxide or an organic matting agent (1–10 μm) such as polymethyl methacrylate. Besides this agent, the upper subbing layer optionally contains various additives such as an anti-halation agent, a coloring a gent, pigment or a coating auxiliary.

The concentration of the subbing layer coating solution is ordinarily not more than 20% by weight and preferably, not more than 15% by weight. The coating amount is 1 to 30 g/m$^2$, and preferably 5 to 20 g/m$^2$ in terms of coating solution weight.

As for a subbing layer coating method, various conventional coating methods can be employed. For example, a roll-coating method, a gravure-roll coating method, a spray coating method, an air-knife coating method, a bar coating method, a dip coating method and a curtain coating method can be used either individually or in combination.

The SPS support has excellent thermal, mechanical, physical, chemical and optical properties and excellent dimensional stability, when the support remains stored in a roll form, curling is likely to produce. The curled support is used for silver halide photographic light sensitive material, the material is likely to cause scratch and unfocussed image after development or jamming during development and printing. Accordingly, an anti-curling treatment is preferably carried out. The anti-curling treatment will be explained below.

In at least one step of the step before a subbing layer coating, a step from after the subbing layer coating to an emulsion layer coating and a step after the emulsion layer coating, heat treatment is carried out at a temperature range of from 40° C. to a temperature of Tg of the support for 0.1 to 1500 hours, whereby curling is difficult to produce. The same effect can be obtained by cooling from a temperature exceeding Tg to a temperature reaching a free volume molecular equilibrium motion. The heat absorption of the resulting support having a small free volume can be easily measured by a differential scanning calorimeter (DSC). The greater the heat absorption is, the smaller the free volume, and curling produces more difficultly.

The position of an endothermic peak appears shifts depending on heat treatment conditions of the support. The peak of the support subjected to higher temperature treatment shifts to higher temperature side. The endothermic peak appearing at a temperature range within which Tg falls is especially useful. The greater the heat absorption amount of such a peak, the smaller the free volume of the support, and curling produces more difficultly. The heat absorption amount is preferably 50 to 1000 mcal/g, and more preferably 200 mcal/g or more. This range of the heat absorption amount is preferable in that anti-curling effect is attained and time required to provide an anti-curling property is saved. The heat absorption amount is measured by DSC, and is given with an area surrounding by a base line and a curve which deviates from the base line and returns to the base line, the area being the peak area including Tg.

The biaxially oriented and heat set film may be sharply cooled and wound around a core. After the film is gradually cooled from Tg to a heat set temperature in 0.1 to 1,500 hours and then wound around a core having a large diameter, the resulting material may be further cooled from 40° C. to Tg at an average cooling speed of –0.01° to –50° C./minute or further heat treated at high temperature before an emulsion coating.

The heat treatment temperature is preferably 55° C. to (Tg –10° C.), and the heating time is preferably 2 to 200 hours in view of productivity and quality. It is preferable in view of prevention of blocking that the heat treatment after a subbing layer coating is carried out at 40° to 70° C. and the heat treatment after an emulsion layer coating at 40° to 65° C.

In the SPS support used in the invention curling degree is 80 m$^{-1}$ or less, and preferably 60 m$^{-1}$ or less, in view of anti-curling property, processability and handling property. The curling degree can be obtained by heating only one surface side of the support or by laminating two or more different SPS supports. The "different" supports herein referred to mean supports different in component in the SPS polymer, which constitutes the supports, in its content, in layer thickness, in molecular weight or in physical properties.

The curling degree was measured according to the following method:

The silver halide photographic light sensitive material sample having 12 cm (length in the longitudinal orientation direction on support manufacturing) ×35 mm (width in the lateral orientation direction on support manufacturing) was stored at 23° C. and 55% RH for one day, wound around a core having a diameter of 10.8 mm in the length direction, and further stored at 55° C. and 20% RH for 4 hours. Thereafter, the resulting sample was further stored at 23° C. and 55% RH for 30 minutes, and unwound. The resulting sample was evaluated for curling degree. The curling degree represented in terms of 1/R (m$^{-1}$), wherein R represents a radius of curvature.

The SPS photographic support obtained as described above is used not only for a silver halide photographic light sensitive material such as a light sensitive material for graphic arts, an X-ray film or IC print board or but also for a film for printing, an OHP film, a marking film, a photochromic light sensitive film or a light sensitive resin film.

A negative original is prepared from a silver halide photographic light sensitive material by printing a circuit diagram from a cad system. The diagram is printed on a copper board by contact-exposing or reduction-exposing to a UV light a copper board having a photosensitive layer in through the original. If foreign matters, which interrupt a UV light, are present on the support of the light sensitive material, a thin line in the diagram is broken or reduced, and the material can not be applicable. In view of the above, it is preferable that the foreign matter number on a support of a light sensitive material for IC is substantially 0 per 75 square centimeter of foreign matters having a size of 40 μm or more, and 50 or less per 75 square centimeter of foreign matters having a size of from less than 40 μm to 10 μm. The term "substantially 0 referred to means that foreign matters having a size of 40 μm or more are extremely rarely present, but usually, no foreign matters are present. The size herein referred to means the maximum length of the straight lines formed by combining two points on foreign matters. When the SPS support is manufactured by a step comprising drying, melting and extruding a SPS polymer, the polymer may be filtered by a nonwoven fabric form sintered porous filter and/or metal particle porous filter having an absolute filter diameter (JIS B 8356) of 9 μm, preferably 5 to 8 μm. The foreign matters herein referred to mean substances interrupting UV light transmission such as polymerization initiators, stabilizers, inactive inorganic or organic additives, polymer blocks produced during polymerization or film manufacturing, dust produced during recovering waste film or thermally producing matters. The foreign matters can be observed at a magnification degree of around 100 times by an optical microscope.

Next, a light sensitive layer of a silver halide photographic light sensitive material will be explained.

A color or black-and-white silver halide emulsion can be applied. Here, a silver halide photographic light sensitive material for graphic arts will be mainly described.

The silver halide grains used in the invention may be ordinary silver halides such as silver bromide, silver chloride, silver iodobromide, silver bromochloride or silver iodobromochloride. They can be obtained by an acid, neutral or ammonia method. The preferable silver halides in the silver halide emulsion for graphic arts are silver chloride, silver bromochloride having a silver chloride content of 60 mol % or more and silver bromoiodochloride having a silver chloride content of 60 mol % or more.

The grains may be grains having a uniform halide composition or core/shell grains where the halide composition inside the grains is different from that of the outer layer of the grains. The grains may be ones in which a latent image is formed mainly inside the grains.

The silver halide grains in the invention may be in a single form or in a mixture of various forms. The silver halide emulsion in the invention may have any particle size distribution. The polydisperse emulsion and monodisperse emulsion may be used in admixture.

In the silver halide photographic light sensitive material for graphic arts a monodisperse emulsion is preferably used. The monodisperse silver halide grains in the monodisperse emulsion are grains comprising grains having a particle size falling within ±20% of a deviation from an average particle size, r in an amount preferably not less than 60% by weight, more preferably not less than 70% by weight, and most preferably not less than 80% by weight based on the total silver halide grains. The grain size herein referred to is a grain diameter when grains are spherical, and, when grains are shapes other than spheres, a diameter of a circle having an area corresponding to their projected area. The highly uniform monodisperse emulsion provides an excellent image as a photographic image. The monodisperse emulsion is obtained by a method disclosed in Japanese Patent O.P.I. Publication Nos. 55-48521/1980, 55-49938/1980 and 60-122935/1985.

The silver halide grain shape is not specifically limited, and may be tabular, spherical, cubic, tetradecahedral, octahedral and the like. For example, the tabular grains can be obtained according to a method disclosed in Japanese Patent O.P.I. Publication Nos. 5-204070/1993.

As a method of reacting a soluble silver ion with a soluble halide in the manufacture of a silver halide emulsion, a normal precipitation method, a double jet precipitation method or a combination thereof can be used.

A method of forming grains in the presence of an excess silver ion, so-called a reverse precipitation method can be used. As one method of the double jet precipitation, a method of maintaining pAg of the silver halide forming solution constant, so-called a controlled double jet method can be used. According to this method, silver halide grains of regular shape having an approximately uniform grain size.

During silver grain formation or growth, at least one of salts or complexes of cadmium, zinc, lead, thallium, ruthenium, osmium, iridium or rhodium are preferably added to the silver halide emulsion.

The silver halide emulsion and the preparing method thereof are detailed in Research and Disclosure (RD), 176 17643, p. 22–23 (December, 1978) or in references cited in the same.

The silver halide emulsion which is not subjected to chemical sensitization, so-called a primitive emulsion is also used, but the silver halide emulsion is preferably chemically sensitized.

To the emulsion used in the silver halide photographic light sensitive material of the present invention, various photographic additives can be added during a physical ripening step or before or after a chemical ripening step. As additives used in such a step, for example, compounds described in the following RD are cited.

In order to improve dot quality of an image, a light sensitive material for graphic arts of silver halide photographic light sensitive materials contains a contrast increasing agent in the silver halide emulsion layer or in the non-light sensitive layer, or is processed employing a processing solution containing a contrast increasing agent. The excellent contrast increasing agent includes the following hydrazine compound and tetrazolium compound. The typical compound thereof will be shown below, but is not limited thereto.

H-1
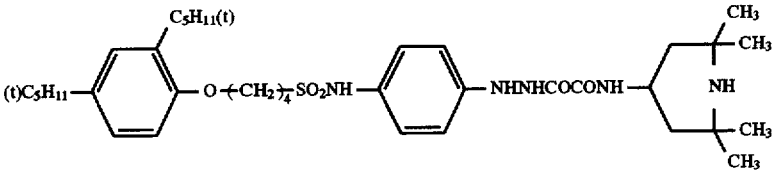
H-2
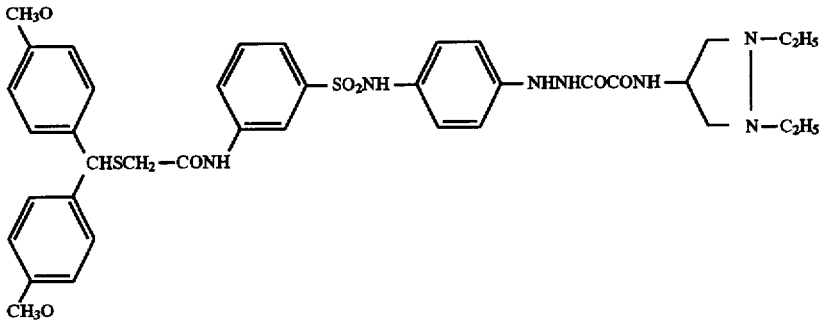
H-3
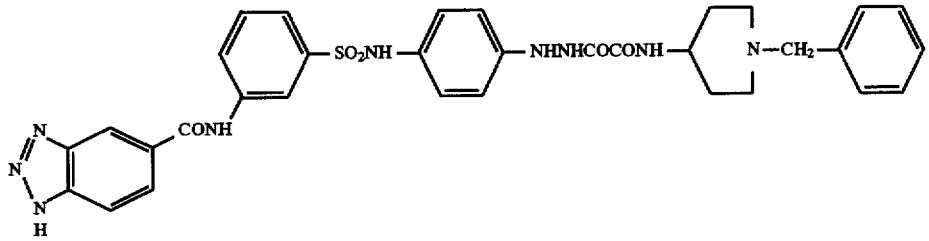
H-4
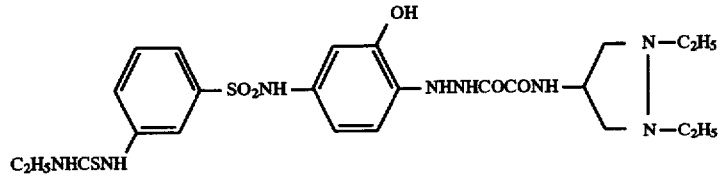
H-5
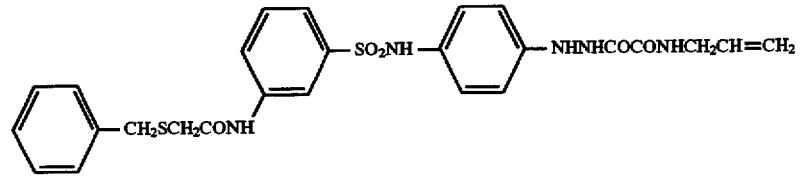
H-6
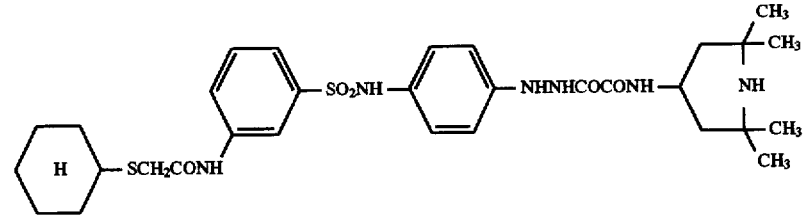

-continued
H-7
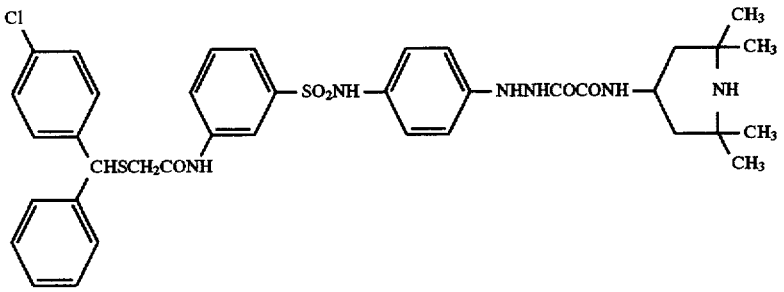
H-8
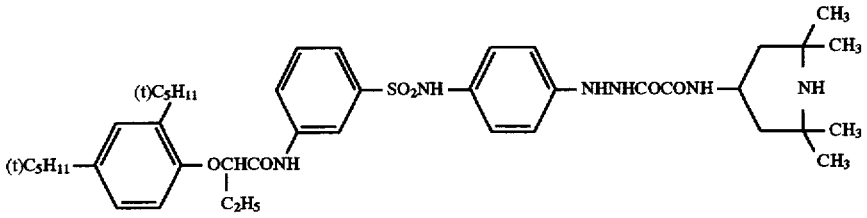
H-9
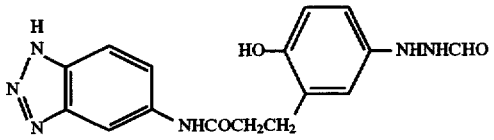
H-10
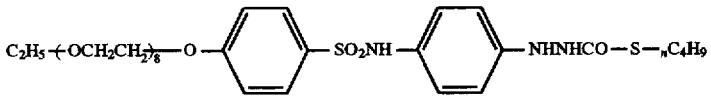
H-11
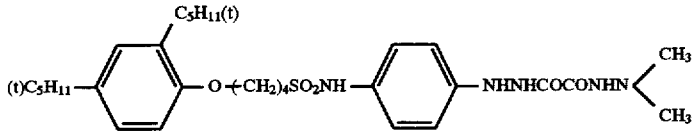
H-12
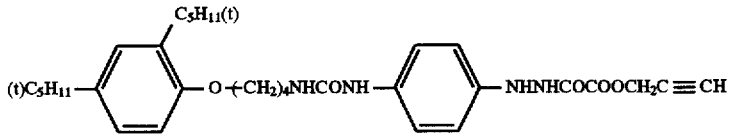
H-13
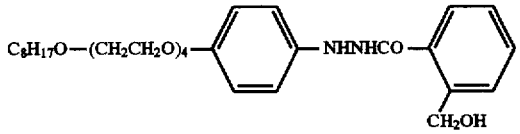
H-14
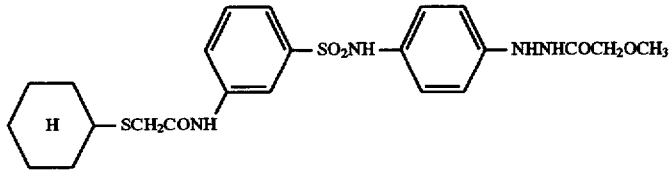

-continued
H-15
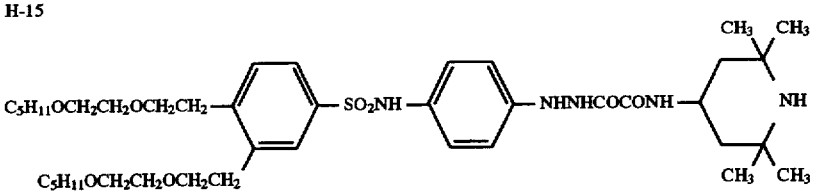
H-16
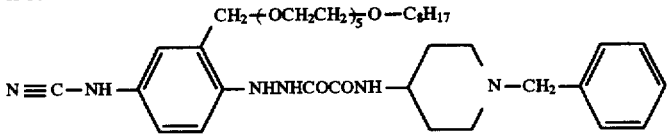
H-17
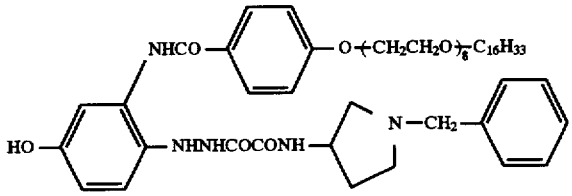
H-18
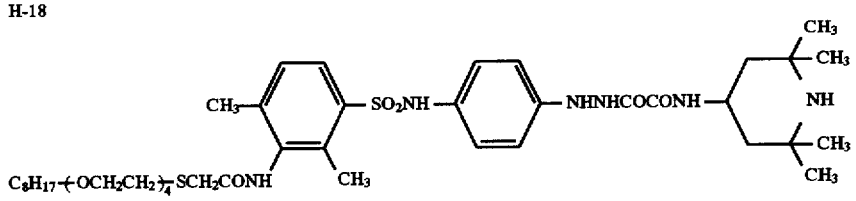
H-19
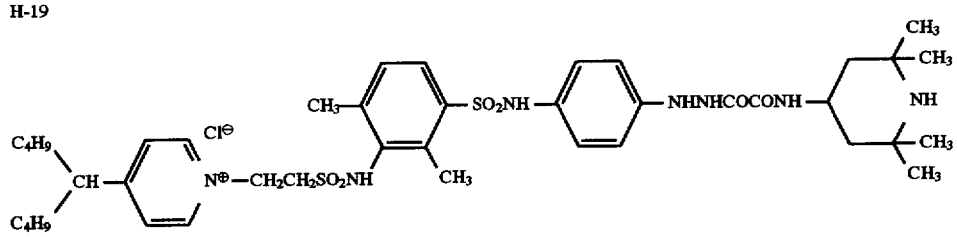
H-20
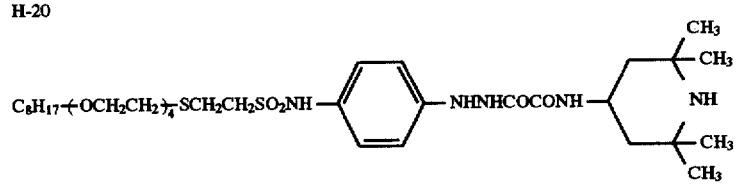
H-21
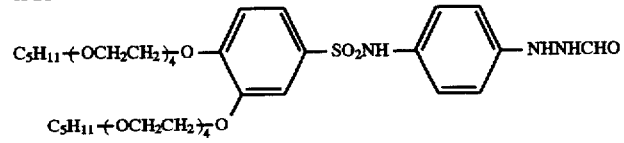
H-22
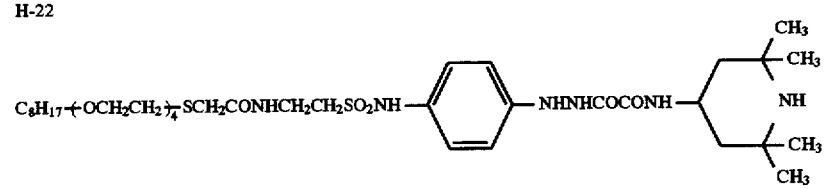

-continued

H-23

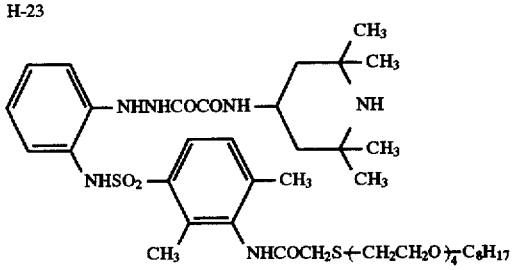

H-24

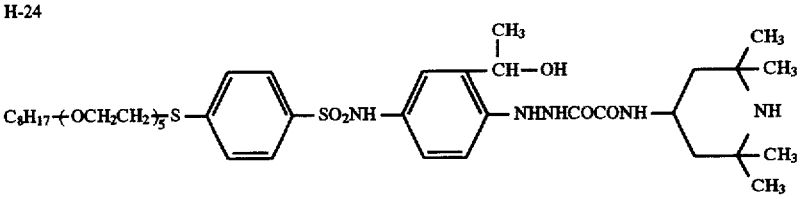

H-25

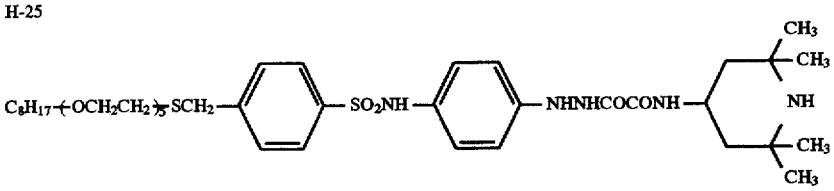

Formula [T]

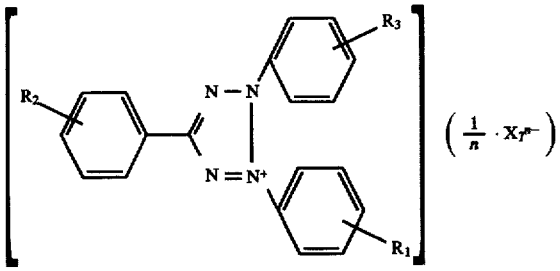

| Compound No. | $R_1$ | $R_2$ | $R_3$ | $X_T^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

To the emulsion used in the silver halide photographic light sensitive material of the present invention, various photographic additives can be added during a physical ripening step or before or after a chemical ripening step. As additives used in such a step, for example, compounds described in RD Nos. 17643, 18716 and 308119 (December, 1989) are cited. Kind of compound and place described in these three RDs are illustrated as follows:

| Additive | RD-17643 Page | RD-17643 Classification | RD-18716 Page | RD-308119 Page | RD-308119 Classification |
|---|---|---|---|---|---|
| Chemical sensitizer | 23 | III | 648 upper right | 996 | III |
| Sensitizing dye | 23 | IV | 648–649 | 996–8 | IV |
| Desensitizing dye | 23 | IV | | 998 | B |
| Pigment | 25–26 | VIII | 649–650 | 1003 | VIII |
| Development accelerator | 29 | XXI | 648 upper right | | |
| Anti-foggant and stabilizer | 24 | IV | 649 upper right | 1006–7 | VI |
| Brightening agent | 24 | V | | 998 | V |
| Hardener | 26 | X | 651 left | 1004–5 | X |
| Surfactant | 26–27 | XI | 650 right | 1005–6 | XI |
| Plasticizer | 27 | XII | 650 right | 1006 | XII |
| Lubricant | 27 | XII | | | |
| Matting agent | 28 | XVI | 650 right | 1008–9 | XVI |
| Binder | 26 | XXII | | 1003–4 | IX |
| Support | 28 | XVII | | 1009 | XVII |

There is a color film or a light sensitive material for graphic arts in a silver halide photographic light sensitive material having a light sensitive layer on one side of a support, and an X-ray film in a silver halide photographic light sensitive material having a light sensitive layer on each side of a support. A backing layer is ordinarily provided in the side of the support opposite the emulsion layer in the silver halide photographic light sensitive material having a light sensitive layer on one side of the support and the resulting material is packaged in the form of roll. In a silver halide photographic light sensitive material for graphic arts, a silver halide emulsion layer and an emulsion protective layer are provided on the emulsion side of a support, and a backing layer including a layer having a certain function and its protective layer is provided on the side opposite the emulsion layer. The layer number of each of the silver halide emulsion layer or backing layer is not limited.

Each of the backing layers can give function. The layer having the function includes an anti-static layer, an anti-halation layer, an anti-irradiation layer, and a magnetic recording layer. These layers may be positioned adjacent to the subbing layer or at the surface depending on their objects.

The binder used in the backing layer is most preferably gelatin. The gelatin includes a lime-processed gelatin, an acid processed gelatin, an enzyme processed gelatin, a gelatin derivative and a modified gelatin, and processed gelatin, and the lime-processed gelatin or the acid processed gelatin is preferably used. Further, another hydrophilic polymer known in the art can be used.

It is important in the light sensitive material for graphic arts that curling balance of the support is maintained between the emulsion layer side and the backing layer side. The weight ratio (a backing layer/a light sensitive layer) of the binder such as gelatin in the backing layer to the hydrophilic polymer such as gelatin in the light sensitive layer side is preferably not less than 0.1, and especially preferably 0.32 to 1.50. This ratio depends on material or thickness of the support, the total hydrophilic polymer (gelatin etc.) content, a silver amount or an additive (for example, latex) content. This ratio is determined by curl balance of the light sensitive material, development processing speed or drying speed after processing.

As describe above, various function are given to the backing layer.

For example, in the anti-halation or anti-irradiation layer to improve image sharpness of silver halide photographic light sensitive material are used anti-halation dyes or anti-irradiation dyes disclosed in the dye item of the above described RD.

In order to prevent adherence of the light sensitive layer to the backing layer in silver halide photographic light sensitive material are used matting agents or lubricants disclosed in the above described RD. The shape or size of the matting agent is not limited, but the matting agent may be a spherical agent having an average particle size of 10 to 50 μm.

The lubricant includes the following agent in addition to those disclosed in the above described RD. The typical agent includes a silicone lubricant disclosed in U.S. Pat. No. 3,042,522, British Patent No. 955,061, U.S. Pat. Nos. 3,080,317, 4,004,927, 4,047,958, and 3,489,576, British Patent No. 1,143,118 and Japanese Patent O.P.I. Publication No. 60-140341/1985, a higher fatty acid, alcoholic, or acid amide lubricant disclosed in U.S. Pat. Nos. 2,454,043, 2,732,305, 2,976,148 and 3,206,311 and German Patent Nos. 1,284,295 and 1,284,294, a metal soap disclosed in British Patent No. 1,263,722 and U.S. Pat. No. 3,933,516, an ester or ether lubricant disclosed in U.S. Pat. Nos. 2,588,765 and 3,121,060 and British Patent No. 1,198,387, and a taurin lubricant disclosed in U.S. Pat. Nos. 3,502,437 and 3,042,222.

Anti-halation can be attained by providing at least one anti-halation layer on the subbing layer on the backing layer side of a silver halide photographic light sensitive material or also by a backing layer or protective layer containing an anti-halation agent. As an anti-halation agent, those known in the art can be used. For example, the agent includs a styrene-sodium maleate copolymer disclosed in Japanese Patent Publication Nos. 47-28937/1972 and 49-23828/1974, a sodium vinylbenzyl sulfonate copolymer disclosed in Japanese Patent O.P.I. Publication No. 53-82876/1978, an anionic polymer anti-halation agent such as a sodium styrene sulfonate copolymer disclosed in Japanese Patent Publication No. 48-23451/1973, an ionene compound (for example, polycondensate of triethylenediamine and xylidene dichloride) disclosed in Japanese Patent Publication Nos. 55-42535/1980, 54-159222/1979 and 55-7763/1980, polymethacroylethyldiethylmethyl ammonium methylsulfonate disclosed in U.S. Pat. No. 2,882,157, a cross-linked copolymer particles having a quaternary ammonium group in the side chain (for example, copolymer [N,N,N-trimethyl-N-vinylbenzyl ammonium chloride-co-divinylbenzene]) disclosed in Japanese Patent Publication No. 60-51693/1985, and Japanese Patent O.P.I. Publication Nos. 61-223736/1986 and 62-9376/1987, those having alumina sol as a main component disclosed in Japanese Patent Publication Nos. 57-12979/1982, fine particle metal oxides such as ZnO, $SnO_2$, $TiO_2$, $Al_2O_3$, $In_2O_3$, $SiO_2$, MgO, BaO, $MoO_3$, $ZnO_2$ disclosed in Japanese Patent O.P.I. Publication Nos. 57-104931/1982, a metal oxide such as $V_2O_5$ disclosed in Japanese Patent Publication No. 55-5982/1980, a higher fatty alcohol phospate anti-halation agent disclosed in Japanese Patent Publication No. 52-32572/1977, and a π electron conductive polymer such as poly-(5-dodecylbenzothiophene), poly-(3,4-diethoxythiophene), poly(3,4-methoxypyrrole), poly(paraphenylenevinylene) or methacroylethyloxy-3-polythiophene disclosed in Japanese Patent Publication Nos. 2-252726/1990, 2-255770/1990, 2-304554/1990 and 2-308246/1990, European Patent Publication No. 593111A1, and Ogata Naoya, "Coductive Polymer", issued by Kodan Sha (1990). The above anti-halation layer may contain a binder, and the binder includes gelatin, a gelatin derivative cellulose acetate and a vinyl polymer latex.

The light sensitive material for graphic arts preferably has an anti-halation layer on the backing layer side. The anti-halation layer may be provided on the subbing layer, the upper subbing layer, the lower protective layer or the upper protective layer.

Even if low sensitive, the light sensitive material for graphic arts is demanded to secure a permanent anti-static property even after being processed to prevent static shock to an operator, difficulty in film separation or quality deterioration due to dust absorption. In order to meet such a demand, an anti-static agent such as a fine particle metal oxide analogous to a semiconductor is preferably used.

The backing layer may contain a gelatin hardener, an ultraviolet light absorber, a softening agent or polymer latex. The hardener includes those described in the above subbing layer and those above described.

The coating method of the backing layer is not limited, but the method includes the methods described in the above subbing layer.

In the development process are used developing agents described in Journal of the American Chemical Society, Volume 73, on page 100 (1951). The light sensitive material for graphic arts can be processed according to the process disclosed in for example, Japanese Patent O.P.I. Publication Nos. 5-123292/1989 and 53-17719/1978.

Next, a measuring method of refractive index will be explained.

<Measuring Method of Refractive Index>

The refractive index was measured using an Abbe's refractometer produced by Agoda Co., Ltd. The polarizing light plate was set at an eyepiece. Then, the polarizing plate and sample were directed to accord with the measurement direction and the refractive index lenz was measured. α-bromonaphthalene was used as an intermeadiate liquid. Refractive indexes in each of the logitudinal, lateral and 45° directions of the support sample were measured at respective five spots, and their average was calculated as a plane average index.

Next, the measurement of ($\alpha_t$) and ($\alpha_h$) will be explained.

(a) Hygroscopic Expansion Coefficient ($\alpha_h$)

($\alpha_h$) of the sample was measured using Thermo Mechanical Analyzer (TMA) ULVAC-TM7000 Type (produced by Shinkuriko Co., Ltd.). The sample was cut into 5 mm (width)×25 mm (length). The resulting sample was perpendicularly set in the length direction and cramped with a clip of TMA at points 5 mm distant from the upper and lower edges of the sample. After 5 g of load was applied to the sample, dimensional changes of the 15 mm long sample were continuously recorded while varying from 11 to 80% RH at 23° C. The slope thereof was calculated as ($\alpha_h$).

(b) Thermal Expansion Coefficient ($\alpha_t$)

($\alpha_t$) of the sample was measured by the above analyzer varying temperature or according to description in ASTM.D696-70. The latter method was employed in the invention.

Refractive index, ($\alpha_t$) and ($\alpha_h$) of a first SPS photographic support after film manufacturing were compared with those of a second SPS support obtained by removing photographic layers including a light sensitive layer on the support of a silver halide photographic light sensitive material with a bleaching solution (Hitor produced by KAO Co., Ltd.), but there was no difference between them. Thus, hereinafter, ($\alpha_t$) and ($\alpha_h$) of the SPS photographic support after film manufacturing were measured.

The invention will be detailed in the following examples, but is not limited thereto.

EXAMPLES

[Preparation of SPS Photographic Support]

<Preparation of SPS Pellets>

ASPS pellet was manufactured according to the method disclosed in Japanese Patent O.P.I. Publication No. 3-131843/1991. All the operations from catalyst preparation to polymerization were carried out in the argon atmosphere. 17.8 g (71 mmol) of cupric sulfate pentahydrate ($CuSO_4.5H_2O$), 200 ml of purified benzene and 24 ml of trimethyl aluminium were put in a 500 ml glass vessel, and agitated at 40° C. for eight hours to prepare a catalyst. After this was filtered with glass filter of No. 3A in the argon atmosphere, and the filtered solution was freeze-dried. Then, the produced material was taken out and the produced material, tributyl aluminium pentamethylcyclopentadiethyl titanium trimethoxide were put into a stainless reaction vessel having the inner volume of 2 liters, and heated to 90° C. Then, 1 liter of purified styrene was added to this and the mixture was subjected to polymerization reaction at this temperature for 8 hours. Thereafter, the resulting mixture was cooled to room temperature and one liter of methylene chloride was added, and a methanol solution of sodium methylate was added under agitation to deactivate the catalyst. After the mixture was added dropwise gradually into 20 liters of methanol, the precipitation was filtered with a glass filter of No. 3 and washed with 1 liter of methanol for three times, and this was dried under reduced pressure for 12 hours. Thus, SPS resin was obtained. The weight average molecular weight measured by GPC using 1,2,4-trichlorobenzene as a solvent was 280,000 in terms of standard polystyrene. The melting point of this resin was 245° C. The above obtained resin had a syndiotactic structure from a carbon thirteen NMR measurement. This SPS resin was extruded at 300° C. by an extruding machine to make pellets.

Preparation of SPS photographic support

The resulting SPS pellets were dried at 130° C. for 3 hours using a whirling vacuum dryer to crystalize. The crystalized SPS pellets were incorporated in an extruder, melted at 330° C., extruded through a pipe on a 40° C. cooled casting drum from a die-slit, brought into contact with the drum while applying electrostatic potential and cooled, to obtain an unoriented sheet. The resulting sheet was firstly oriented at 125° C. in the longitudinal direction with a draw ratio shown in Table 2 using an orientation apparatus having a combined rolls in the longitudinal direction, further oriented at 128° C. in the lateral direction with a draw ratio shown in Table 2 clamping the both ends of the sheet with clips, and then heat set at 250° C. for 30 seconds and cooled. Thus, a 100 μm thick SPS photographic support was obtained.

The both surfaces of the thus obtained support were subjected at 7 (W·minute/$m^2$) to corona discharge treatment, and discharged with an ion wind using an ion blower (RH-20 Type). Thereafter, subbing layer coating solutions a-1 and b-1 were coated on both surfaces one by one in order so that the dry thickness of the layer was set to be 1.0 μm, and, subsequently dried at 160° C. to obtain the subbing layers A-1 and B-1.

Next, subbing layer coating solutions a-2 and b-2 were coated on the above subbing layers one by one in order so that the dry thickness of the layer was set to be 0.2 μm, and, subsequently dried at 140° C. to obtain the subbing layers A-2 and B-2.

| <Subbing layer coating solutions a-1 and b-1> | |
|---|---|
| Styrene-butadiene latex (Nippol LX432A; product of Nippon Zeon Co., Ltd.) | 25 parts by weight |
| Methyl cellulose (10%) | 10.0 parts by weight |
| Silica-type matting agent (average diameter: 3.0μ) | 0.5 part by weight |
| C-1 | 0.5 part by weight |
| Pure water | 66 parts by weight |

| <Subbing layer coating solutions a-2 and b-2> | |
|---|---|
| Aqueous gelatin solution (10%) | 80 parts by weight |
| Methyl cellulose (10%) | 20 parts by weight |
| $C_{12}H_{25}O(CH_2CH_2O)_{10}SO_3Na$ | 4 parts by weight |
| Proxel | 0.3 part by weight |
| (C-1) | 0.5 part by weight |
| Add pure water to make the total volume of 1 liter. | |

The above subbing layer B-2 was subjected at 8 (W/m2·minute) to corona discharge treatment, and the following metal oxide complex anti-static solution (b-3) was coated on the subbing layer so that the dry thickness of the layer was set to be 0.1 μm, and subsequently dried at 160° C. to obtain the anti-static layer B-3.

<Conductive Anti-static Agent Comprised of Metal Oxide Complex Fine Particles>

In a 3000 parts by weight ethanol were dissolved 230 parts by weight of stannic chloride and 23 parts by weight of antimony trioxide to obtain a solution. A 1N sodium hydroxide solution was added to the resulting solution to adjust to pH 3. Co-precipitate of colloidal stannic oxide and antimony oxide was produced and allowed to stand at 50° C. for 24 hours to obtain red-brown co-precipitate. The co-precipitate was separated by a centrifuge. In order to remove excess ion, the resulting precipitate was added with water and further separated by a centrifuge. This washing was repeated three times. The resulting colloidal precipitate of 200 parts by weight was dispersed into 1500 parts by weight of water and jetted into a baking furnace of 600° C. The bluish stannic oxide-antimony oxide complex fine particles having an average particle size of 0.2 μm were obtained. The specific resistance of the fine particles was 25 Ω·cm. The above obtained fine particles of 40 parts by weight and 60 parts by weight of water were mixed, and the mixture was adjusted to pH 7.0. After the resulting mixture was pre-dispersed by a stirrer, and further dispersed in a lateral sand mill, Daino-mill (trade name) produced by WILLYA BACHOFENAG Company to obtain a dwelling time of 30 minutes. Thus, a conductive fine particle dispersion was obtained.

| <Anti-static solution (b-3)> | |
|---|---|
| The above conductive fine particle dispersion | 10 parts by weight |
| Gelatin | 1 parts by weight |
| Water | 10 parts by weight |
| Methanol | 62 parts by weight |
| Polyoxyethylenenonylphenyl ether | 0.01 parts by weight |
| Hexamethylene-1,6-bisethyleneurea | 0.6 parts by weight |

<Preparation of Comparative Sample>

The both surfaces of a commercially available 100 μm thick PET film, which was biaxially oriented and heat set, were subjected at 8 W/m$^2$-minute to corona discharge treatment, and the following subbing layer coating solution a-11 was coated on one surface so that the dry thickness of the layer was set to be 0.8 μm and dried to obtain the subbing layer A-11, and the following subbing layer coating solution b-11 was coated on the other surface so that the dry thickness of the layer was set to be 0.8 μm and dried to obtain the subbing layer B-11.

| <Subbing layer coating solutions a-11> | |
|---|---|
| Latex (solid concentration of 30%) containing a copolymer of butylacrylate, t- butylacrylate, styrene and 2 hydroxyethylacrylate (30:20:25:25 weight ratio) | 270 parts by weight |
| C-1 | 0.6 parts by weight |
| Hexamethylene-1,6-bis(ethyleneurea) | 0.8 parts by weight |
| Add pure water to make the total volume of 1 liter. | |

| <Subbing layer coating solution b-11> | |
|---|---|
| Latex (solid concentration of 30%) containing a copolymer of butylacrylate, styrene and glycidylacrylate (40:20:40 weight ratio) | 270 parts by weight |
| C-1 | 0.6 parts by weight |
| Hexamethylene-1,6-bis(ethyleneurea) | 0.8 parts by weight |
| Add pure water to make the total volume of 1 liter. | |

The both surfaces of the subbing layers A-11 and B-11 were subjected at 8(W/m$^2$ minute) to corona discharge. Thereafter, the following subbing layer coating solution a-21 was coated on the subbing layer A-11 so that the dry thickness of the layer was set to be 0.1 μm and dried to obtain the subbing layer A-21, and the following subbing layer coating solution b-21 was coated on the subbing layer B-11 so that the dry thickness of the layer was set to be 0.8 μm and dried to obtain the subbing layer B-21.

| <Subbing upper layer coating solutions a-21> | |
|---|---|
| Gelatin | 0.4 g/m$^2$ |
| C-1 | 0.2 parts by weight |
| C-2 | 0.2 parts by weight |
| C-3 | 0.1 parts by weight |
| Silica particles (average sixe 3 μm) | 0.1 parts by weight |
| Add pure water to make 1 liter. | |
| <Subbing upper layer coating solutions b-21> | |
| C-4 | 60 parts by weight |
| Latex (solid concentration of 30% containing C-5 | 80 parts by weight |
| Ammonium sulfate | 0.5 parts by weight |
| C-6 | 12 parts by weight |
| Polyethylene glycol (weight average molecular weight 600) | 6 parts by weight |
| Add pure water to make 1 liter. | |

(C-1)

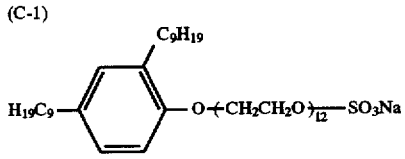

(C-2)

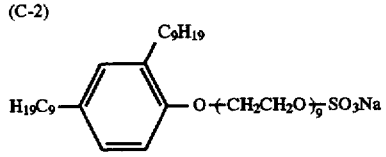

-continued (C-3)

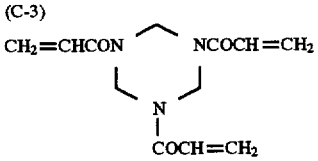

(C-4)

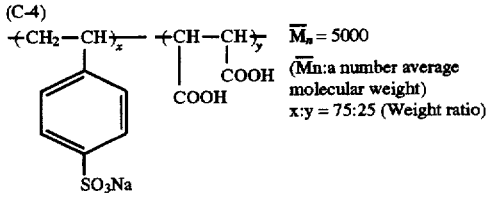

$\overline{M}_n$ = 5000

($\overline{M}$n:a number average molecular weight)

x:y = 75:25 (Weight ratio)

(C-5)

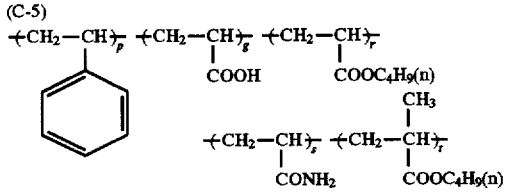

p:g:r:s:t = 40:5:10:5:40 (Weight ratio)

(C-6)

A mixture of the following three compounds

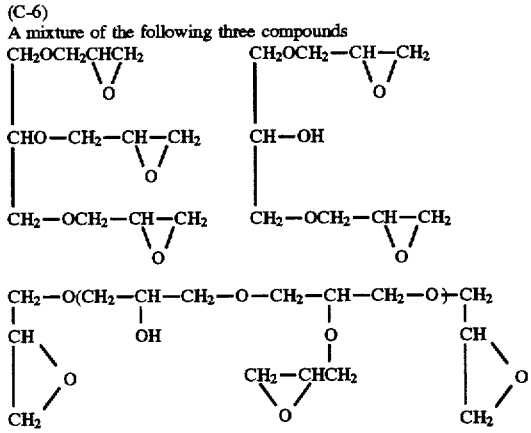

The above subbing layer B-21 was subjected at 8 W/m$^2$ minute to corona discharge treatment, and the above metal oxide complex anti-static solution (b-3) was coated on the subbing layer so that the dry thickness of the layer was set to be 0.1 μm, and subsequently dried at 160° C. to obtain antistatic layer B-31.

<Preparation of Silver Halide Photographic Light Sensitive Material Sample having a PSP Photographic Support and Comparative Sample>

The following coating solutions including the silver halide emulsion were coated on the above obtained layers A-2 and A-21 and the following backing layer coating solution was coated on the above obtained layers B-3 and B-31. Thus, a silver halide photographic light sensitive material sample for graphic arts were obtained.

(Preparation of Silver Halide Emulsion A)

Silver bromochloride core grains comprised of 70 mol % of silver chloride and silver bromide, which had an average thickness of 0.05 μm and an average diameter of 0.15 μm, were prepared in a double-jet precipitation method. In the process $K_3RuC_{16}$ was added in an amount of $8\times10^{-8}$ mol/mol of silver. The shell was formed on the core in a double-jet precipitation method, while $K_2IrCl_6$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.2 mol % of silver iodide and silver bromide), having an average thickness of 0.10 μm and an average diameter of 0.29 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $2\times10^{-5}$ mol/mol of silver of chloroauric acid and $3\times10^{-6}$ mol/mol of silver of inorganic sulfur and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion A.

(Preparation of Silver Halide Emulsion B)

Silver iodobromochloride core grains comprised of 60 mol % of silver chloride, 2.5 mol % of silver iodide and silver bromide, which had an average thickness of 0.05 μm and an average diameter of 0.15 μm, were prepared in a double-jet precipitation method. In the process $K_3RhBr_6$ was added in an amount of $2\times10^{-8}$ mol/mol of silver. The shell was formed on the core in a double-jet precipitation method, while $K_2IrCl_{16}$ was added in an amount of $3\times10^{-7}$ mol/mol of silver. The resulting emulsion was proved to be an emulsion comprising tabular core/shell type monodisperse (a variation coefficient of 10%) silver bromoiodochloride grains (comprised of 90 mol % of silver chloride, 0.5 mol % of silver iodide and silver bromide), having an average thickness of 0.10 μm and an average diameter of 0.42 μm. Thereafter, the emulsion was desalted with denatured gelatin disclosed in Japanese Patent O.P.I. Publication No. 2-280139/1990 (one in which an amino group in gelatin is substituted with a phenylcarbamyl group, for example, Exemplified compound G-8 on page 287(3) in Japanese Patent O.P.I. Publication No. 2-280139/1990). The resulting EAg after the desalting was 190 mv at 50° C.

To the emulsion was added $1\times10^{-3}$ mol per mol of silver of 4-hydroxy-6-methyl-1,3,3a,7-tetrazaindene. Potassium bromide and citric acid were added, and adjusted to be pH 5.6 and EAg 123 mv. To the emulsion were added $2\times10^{-5}$ mol/mol of silver of chloroauric acid and $3\times10^{-5}$ mol/mol of silver of N,N,N'-trimethyl-N'-heptafluoroselenourea and the mixture was chemically ripened at 60° C. to obtain a maximum sensitivity. After the ripening, $2\times10^{-3}$ mol per mol of silver of 4-hydroxy-6-methyl-1,3,3a,7-tetrazaindene, $3\times10^{-4}$ mol per mol of silver of 1-phenyl-5-mercaptotetrazole and gelatin were added to the emulsion to obtain silver halide emulsion B.

(Preparation of Silver Halide Photographic Light-Sensitive Material for Graphic Arts for He-Ar Laser Light)

On the subbing layer A-2 of each of the above SPS photographic supports and on the subbing layer A-21 of the above comparative support were simultaneously coated using an extrusion coater the following gelatin layer composition, Prescription 1 in an amount of 0.5 g/m$^2$, the following silver halide emulsion 1 composition, Prescription 2 in an amount of 2.9 g/m$^2$ of silver and of 0.5 g/m$^2$ of gelatin, the following intermediate layer composition, Prescription 3 in an amount of 0.3 g/m$^2$ of gelatin, the following silver halide emulsion 2 composition, Prescription 4 in an amount of 0.2 g/m$^2$ of silver and of 0.4 g/m$^2$ of gelatin, and the following protective layer composition, Prescription 5 in an amount of 0.6 g/m$^2$ of gelatin, in that order. On the subbing layers B-3 and B-31 of the support opposite the emulsion layer were simultaneously coated the following backing layer composition, Prescription 6 in an amount of 0.6 g/m$^2$ of gelatin, the following polymer layer composition, Prescription 7, and the following backing protective layer composition, Prescription 8 in an amount of 0.4 g/m$^2$ of gelatin, in that order. Thus, silver halide photographic light sensitive material samples for graphic arts for a He-Ne laser were prepared.

| | |
|---|---|
| Prescription 1 (gelatin layer composition) | |
| Gelatin | 0.5 g/m$^2$ |
| Solid dispersion particles of AD-1 (Average diameter 0.1 μm) | 25 mg/m$^2$ |
| Polystyrene sodium sulfonate (Average molecular weight 500,000) | 10 mg/m$^2$ |
| Sodium isoamyl-n-decylsulfosuccinate (S-1) | 0.4 mg/m$^2$ |
| Prescription 2 (silver halide emulsion layer 1 composition) | |
| Silver halide emulsion A | 1.5 g/m$^2$ (in terms of silver) |
| Solid dispersion particles of AD-8 (Average diameter 0.1 μm) | 20 mg/m$^2$ |
| Cyclodextrin | 0.5 g/m$^2$ |
| Sensitizing Dye d-1 | 5 mg/m$^2$ |
| Sensitizing Dye d-2 | 5 mg/m$^2$ |
| H-7 | 20 mg/m$^2$ |
| RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 mg/m$^2$ |
| 2-Mercapto-6-hydroxypurine | 5 mg/m$^2$ |
| EDTA | 30 mg/m$^2$ |
| Colloidal silica (average diameter 0.05 μm) | 10 mg/m$^2$ |
| Prescription 3 (intermediate layer composition) | |
| Gelatin | 0.3 g/m$^2$ |
| S-1 | 2 mg/m$^2$ |
| Prescription 4 (silver halide emulsion layer 2 composition) | |
| Silver halide emulsion B | 1.4 g//m$^2$ (in terms of silver) |
| Sensitizing Dye d-1 | 3 mg/m$^2$ |
| Sensitizing Dye d-2 | 3 mg/m$^2$ |
| H-20 | 20 mg/m$^2$ |
| Na-3 | 40 mg/m$^2$ |
| RE-2 | 20 mg/m$^2$ |
| 2-Mercapto-6-hydroxypurine | 5 mg/m$^2$ |
| Latex polymer f | 0.5 g/m$^2$ |
| EDTA | 20 mg/m$^2$ |
| S-1 | 0.5 mg/m$^2$ |
| Prescription 5 (emulsion protective layer composition) | |
| Gelatin | 0.6 g/m$^2$ |
| Solid dispersion particles of Dye AD-5 (Average diameter 0.1 μm) | 40 mg/m$^2$ |
| S-1 | 12 mg/m$^2$ |
| Monodispersed silica (an average diameter 0.35 μm) | 25 mg/m$^2$ |
| Na-3 | 40 mg/m$^2$ |
| 1,3-Vinylsulfonyl-2-propanol | 40 mg/m$^2$ |
| Surfactant h | 1 mg/m$^2$ |
| Colloidal silica (Average diameter 0.05 μm)) | 10 mg/m$^2$ |
| K-1 | 30 mg/m$^2$ |
| Prescription 6 (backing layer composition) | |
| Gelatin | 0.6 g/m$^2$ |
| S-1 | 5 mg/m$^2$ |
| Latex polymer f | 0.3 g/m$^2$ |
| Colloidal silica (average diameter 0.05 μm) | 70 mg/m$^2$ |
| Polystyrene sodium sulfonate | 20 mg/m$^2$ |
| Compound i | 100 mg/m$^2$ |
| Prescription 7 (hydrophobic polymer layer composition) | |
| Latex (methylmethacrylate:acrylic acid = 97:3) | 1.0 g/m$^2$ |

-continued
| | |
|---|---|
| Hardener g | 6 mg/m$^2$ |
| Prescription 8 (protective backing layer composition) | |
| Gelatin | 0.4 g/m$^2$ |
| Monodispersed polymethyl methacrylate (an average diameter of 5 μm) | 50 mg/m$^2$ |
| Sodium-di-(2-ethylhexyl)sulfosuccinate | 10 mg/m$^2$ |
| Surfactant h | 1 mg/m$^2$ |
| Dye k | 20 mg/m$^2$ |
| $H-(OCH_2OCH_2)_{68}-OH$ | 50 mg/m$^2$ |
| K-1 | 20 mg/m$^2$ |
Compound i
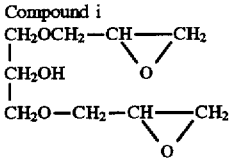
Dye k
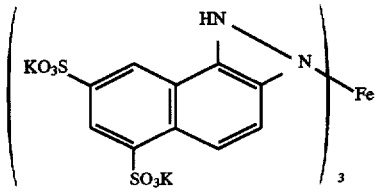
RE-1
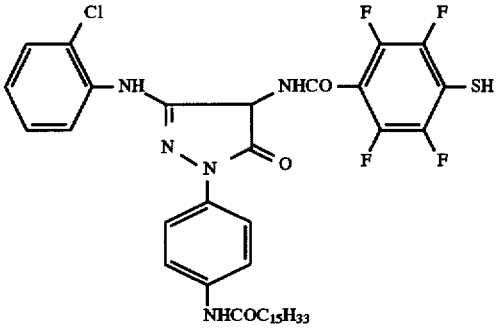
RE-2
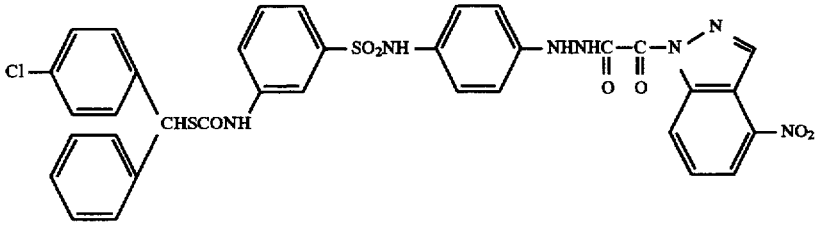
K-1
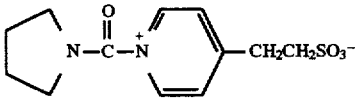
Sensitizing Dye d-1
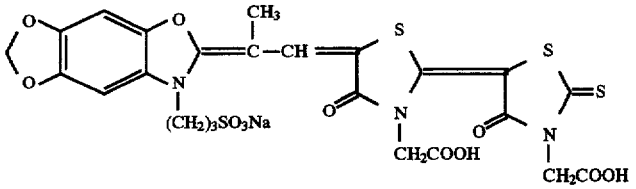

-continued
Sensitizing Dye d-2
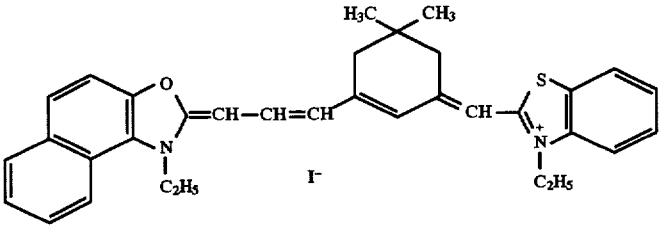
Compound e
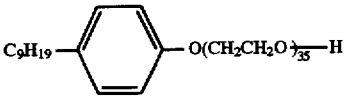
Latex polymer f
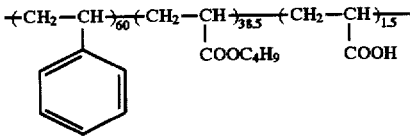
Hardener g
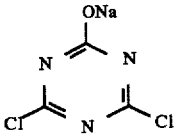
Surfactant h
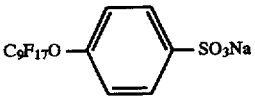
AD-1
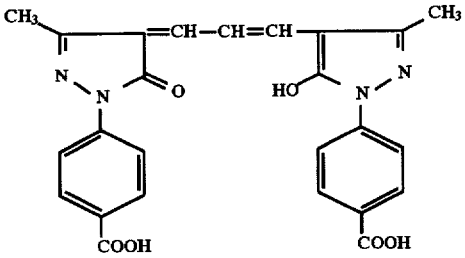
AD-5
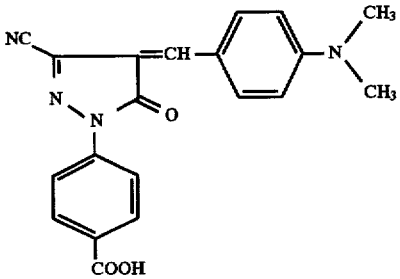

-continued

AD-8

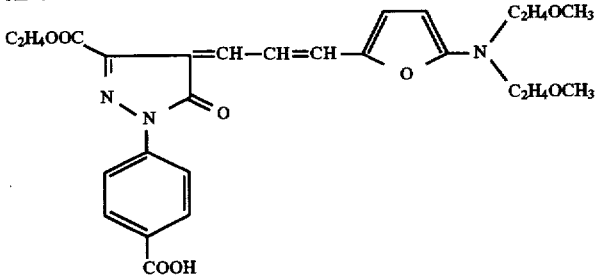

Na-3

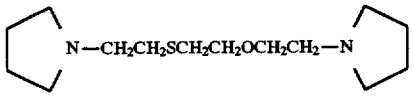

Na-5

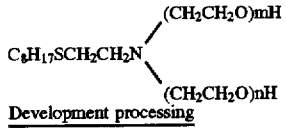

m + n = 20

Development processing

<Development>

Developer composition (amount per 1 liter of developer)

| | |
|---|---|
| Aqueous 40 wt % diethylene triamine pentaacetic acid solution | 3.63 g |
| Sodium sulfite | 16 g |
| Potassium bromide | 76 g |
| Sodium carbonate | 0.9 mol |
| S-36 | 0.1 g |
| A-18 | 25 g |
| Dimeson S | 1.5 g |
| 2-4 | 0.05 mol |
| Benzotriazole | 0.21 g |
| 1-phenyl-5-mercaptotetrazol | 0.025 g |
| pH | 10.3 |

Water, sodium hydroxyde and sulfuric acid were added to make 500 liter and to obtain the above pH. Water of 500 ml was added to make 1 liter. Thus, developer to be used was obtained.

A-18

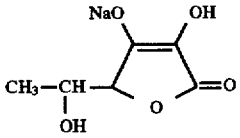

S-36

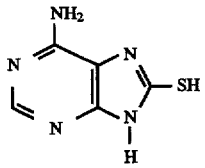

2-4

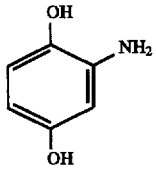

Fixer composition

| | |
|---|---|
| Aqueous 70 wt % ammonium thiosulfate solution | 200 ml |
| Sodium sulfite | 22 g |
| Boric acid | 9.8 g |

-continued

| | |
|---|---|
| Sodium acetate trihydrate | 34 g |
| Aqueous 90 wt % acetic acid solution | 14.5 g |
| Tartaric acid | 3.0 g |
| Aqueous 27 wt % aluminium sulfate | 25 ml |
| Fixer to be used was 4.9. | |
| Water and sulfuric acid were added to make 500 liter and to obtain a pH of 4.9. | |
| Water of 500 ml was added, and fixer to be used was obtained. | |
| <Rinsing solution composition> | |
| EDTA.2Na | 40 g |
| Potassium hydroxide | 23 g |
| Potassium carbonate | 12 g |
| Potassium sulfite | 110 g |
| Sanback-P produced by Sanai Sekitu Co., Ltd.) | 20 g |
| <Processing condition> | |
| Developing 35° C. | 14 seconds |
| Fixing 33° C. | 9 seconds |
| Rinsing 33° C. | 8 seconds |
| Squeezing | 2.5 seconds |
| Drying | 9.5 seconds |
| Sum | 43 seconds |

[Evaluation Method]

<Evaluation of Dimensional Stability of A Silver Halide Photographic Light Sensitive Material Sample>

The above obtained silver halide photographic light sensitive material sample was cut into 30 cm×61 cm and stored in a dark room at 23° C. and 55% RH for 3 hours. A negative and positive original film having two register marks (mark "+") 60 cm distant from each other were also stored in the same conditions as above. Thereafter, the original film was put on the glass plate of a printer having a halogen lamp with its emulsion layer side facing upward, and the sample was superposed on the original film in a such a manner that the emulsion layer of the sample is brought in contact with the emulsion layer of the original film, and a glass plate was further put on the sample. Then, the resulting sample was exposed and processed according to the above processing conditions employing an automatic processor, GX680 produced by Konica Corporation. The processed sample was stored under the above conditions. Two hours after, the resulting processed sample was superposed on the original film in a such a manner that the emulsion layer of the sample is brought in contact with the emulsion layer of the original film, and deviation from the position in the original was measured with a magnifier with the division at the register mark. Deviations of six samples were measured and their average was designated as dimensional deviation. Further, the same evaluation was carried out to obtain the dimensional deviation, except that the test conditions were changed to 23° C. and 40% RH. Table 2 shows a larger value of both values. In either measurement, when the deviation exceeds |20| μm, and particularly 50 μm, apparent dimensional deviation is recognized.

The characteristics of the SPS support and PET support above and the evaluation results are shown in Table 2.

TABLE 2

| | Sample No. | | | | | |
|---|---|---|---|---|---|---|
| Support | 1 SPS | 2 SPS | 3 SPS | 4 SPS | 5 SPS | 6 Commercially available PET |
| Draw ratio | | | | | | |
| Longitudinal | 3.0 | 3.5 | 4.5 | 2.0 | 2.5 | — |
| Lateral | 3.2 | 3.6 | 4.7 | 2.1 | 2.6 | — |
| $[\alpha_t]$/°C. ($\times 10^{-6}$) | 48 | 40 | 31 | 61 | 56 | 20 |
| $[\alpha_h]$/(% RH)($\times 10^{-6}$) | 1 | 0.8 | 0.5 | 1.2 | 1.1 | 10 |
| Refractive index difference | 0.002 | 0.002 | 0.003 | 0.002 | 0.002 | 0.003 |
| Density (kgf/cm$^3$) | 1.040 | 1.040 | 1.041 | 1.037 | 1.039 | 1.401 |
| Haze (%) | 0.8 | 0.8 | 0.7 | 0.8 | 0.8 | 0.5 |
| Contact angle (degree) | 50 | 51 | 50 | 51 | 52 | 70 |
| Dimensional deviation (μm) | 20 | 16 | 11 | 35 | 33 | 50 |

[Results]

The SPS photographic support, biaxially oriented varying an orientation magnification, the larger the draw ratio is, the less the hygroscopic expansion coefficient and thermal expansion coefficient. When hygroscopic expansion coefficient is $1.0\times10^{-6}$/(% RH) or less and thermal expansion coefficient is $50\times10^{-6}$/° C. or less, dimensional deviation is few. The hygroscopic expansion coefficient of the PET photographic support is about 10 to 20 times larger than that of the SPS photographic support, and a silver halide photographic light sensitive material using the PET photographic support has a large dimensional deviation, and the deviation was visually observed.

EXAMPLE 2

The SPS pellets obtained in Example 1 were dried under vacuum at 170° C. for 8 hours, and degassed with an extruder provided with a biaxial bent and capillaries to give a styrene content of 0.03 wt %. The resulting SPS pellets were melt-extruded from a T-die in a film form, cooled at 15° C. on a casting drum, brought into contact with the drum while applying electrostatic potential in such a manner that the surface temperature difference between the contacted and uncontacted parts to the cooled drum was not produced while cooled air was applied to the surface side of the support, which was uncontacted with drum the and then cooled to obtain an unoriented sheet. The resulting sheet was firstly oriented at 90° C. in the longitudinal direction with a draw ratio of 3.4 times, using a roll orientation apparatus. The resulting oriented sheet was further oriented at 70° C. in the lateral direction with a draw ratio of 3.3 times in the direction perpendicular to the longitudinal direction in the sheet plane, and then heat set at 245° C. for 10 seconds and cooled to 85° C. for 10 seconds. Thus, a 100 μm thick SPS photographic support was obtained.

The above obtained support was subjected to heat treatment at 85° C. for 48 hours. Employing this support, a silver halide photographic light sensitive material sample 2—1 was prepared in the same manner as in Example 1.

The characteristics of the SPS support used in sample 2—1 are shown in Table 3.

TABLE 3

| | |
|---|---|
| Sample No. | 2-1 |
| Support | SPS |
| $[\alpha_t]$/°C. ($\times 10^{-6}$) | 35 |
| $[\alpha_h]$/(%RH) ($\times 10^{-6}$) | 0.7 |
| Refractive index difference | 0.002 |
| Density (kgf/cm$^3$) | 1.037 |
| Haze (%) | 0.8 |
| *Endothermic peak (mcal/g) | 340 |
| Contact angle (degree) | 50 |
| Monomer content (wt %) | 0.03 |

*The endothermic peak in above Table is a peak in which Tg is included within a temperature range as the peak occurs.

Sample 2-1 was evaluated according to the following evaluation method.

[Adhesion Property]

The subbing layer and emulsion layer of sample 2-1 were scratched in a lattice form, and the cellophane® was adhered thereto. Thereafter, the adhered tape was sharply peeled and the peeled area of the subbing layer was measured. There was no peeling of the subbing layer.

[Processability]

Sample 2-1 was wound around a core having a diameter of 3 inches at a width of 1 m and at a length of 610 m. The resulting roll film was subjected to heat treatment for 4 hours at 55° C. and 20 % RH, and then cut into a 20×20 inch$^2$film 20 inch×24 inch. The film was applied to a scanner for graphic arts, but there was no jamming. Further, the film had excellent flatness and no problem in processability.

[Flatness]

The surface of the cut film was visually observed with a light at an angle. The film had excellent flat surface and no unevenness of the film surface.

During the coating process the film had excellent dimensional stability.

[Dimensional Stability]

Dimensional stability was evaluated in the same manner as in Example 1. The dimensional deviation was 14 μm, and small.

EXAMPLE 3

In a 500 ml glass vessel charged with argon 17.8 g of cupric sulfate pentahydrate, 200 ml of purified toluene and 24 ml of trimethyl aluminium were put, and reacted at 40° C. for eight hours. The resulting mixture was filtered and the toluene of the filtrate was removed by evaporation at room temperature under reduced pressure to prepare 6.7 g of a catalyst, a reaction product of trimethyl aluminium and water. In a 2 liter stainless reaction vessel 240 ml of purified styrene, 180 ml of purified 4-methylstyrene, 8 mmol of the above obtained catalyst, 8 mmol of triisobutyl aluminium and 0.32 mmol of pentamethylcyclo-pentadienyltitanium trimethoxide were put, heated to 50° C., and reacted for 2 hours. Thereafter, the resulting mixture was cooled to room temperature, and a methanol solution of sodium hydroxide was added under agitation to deactivate the catalyst The resulting precipitation was filtered and repeatedly washed with methanol, and then was dried. Thus, a SPS polymer having a weight average molecular weight of 280,000 was obtained.

This SPS resin was extruded by an extruding machine to make pellets. The resulting SPS pellets were dried at 130° C. for 3 hours under nitrogen atmosphere, and melt extruded at 330° C. in a film form through a porous sintered stainless steel filter having a pore diameter of 8 μm.

The resulting melt-polymer was cooled at 15° C. on a casting drum, brought into contact with the drum while applying electrostatic potential in such a manner that the drum temperature difference between the contacted and uncontacted parts was not produced while cooled air was applied to the surface of the SPS support, and then cooled to obtain an unoriented sheet. The resulting sheet was oriented at 130° C. in the longitudinal direction with orientation magnification degree of 3 times, further at 135° C. in the lateral direction with the orientation magnification degree of 3.1 times, and then heat set at 255° C. for 10 seconds. Thus, a 100 μm thick SPS photographic support was obtained.

This support was cut into 25×30 cm, and foreign matter on this support was observed at a magnification of 100 times through an optical microscope.

The support was subjected to heat treatment at 85° C. for 48 hours. Employing this support, a silver halide photographic light sensitive material sample 3-1 was prepared in the same manner as in Example 1.

The characteristics of the SPS support used in sample 3-1 are shown in Table 4.

TABLE 4

| | |
|---|---|
| Sample No. | 3-1 |
| Support | SPS |
| $[\alpha_t]$/°C. ($\times 10^{-6}$) | 50 |
| $[\alpha_h]$/(%RH) ($\times 10^{-6}$) | 1 |
| Refractive index difference | 0.002 |
| Density (kgf/cm$^3$) | 1.040 |
| Haze (%) | 0.8 |
| Endothermic peak (mcal/g) | 350 |
| Contact angle (degree) | 50 |
| Residual aluminium (wt %) | 0.05 |
| Surface roughness (μm) | 0.007 |

*The endothermic peak in above Table is a peak in which Tg is included within a temperature range as the peak occurs.

Sample 3-1 was evaluated according to the following evaluation method.

[Adhesion Property]

The subbing layer and emulsion layer of sample 3-1 were scratched in a lattice form, and the cellophane® was adhered thereto. Thereafter, the adhered tape was sharply peeled and the peeled area of the subbing layer was measured.

There was no peeling of the subbing layer.

cl [Processability]

Sample 3-1 was wound around a core having a diameter of 3 inches at a width of 1 m and at a length of 610 m. The resulting roll film was subjected to heat treatment for 4 hours at 55° C. and 20 % RH, and then cut into a 20° $inch^2$ film 20 inch 24 inch. The film was applied to a scanner for graphic arts, but there was no jamming. Further, the film had excellent flatness and no problem in processability.

[Flatness]

The surface of the cut film was visually observed with a light at an angle. The film had excellent flat surface and no unevenness of the film surface.

During the coating process the film had excellent dimensional stability.

[Dimensional Stability]

Dimensional stability was evaluated in the same manner as in Example 1. The dimensional deviation was 21 μm, and small.

What is claimed is:

1. A silver halide photographic light sensitive material comprising a support and provided thereon, a silver halide emulsion layer, the support comprising a syndiotactic polystyrene, wherein the support has a thermal expansion coefficient of not more than $50\times10^{-6}$/°C. a hygroscopic expansion coefficient of not more than $15\times10^{-6}$/% RH, and a refractive index which does not exceed 1.585.

2. The material of claim 1, wherein the support has a thermal expansion coefficient of not more than $50\times10^{-5}$/°C. and a hygroscopic expansion coefficient of not more than $1\times10^{-6}$/% RH.

3. The material of claim 1, wherein the support has a refractive index in a thickness direction of not more than 1.625.

4. The material of claim 1, wherein density of the support is not more than 1.05 $g/cm^3$.

5. The material of claim 3, wherein the refractive index difference in a thickness direction between both surfaces of the support is $4\times10^{-3}$ or less.

6. The material of claim 1, wherein haze of the support is 1.2% or less.

7. The material of claim 1, wherein the support is subjected to heat treatment at 40° C. to a temperature not more than Tg of the support for 0.1 to 1,500 hours.

8. The material of claim 1, wherein the heat absorption amount of an endothermic peak of the support is 50 to 1,000 mcal/g, said peak producing at the temperature range including Tg.

9. The material of claim 1, wherein the support is surface treated and the surface has a surface having a contact angle with water of 65°or less.

10. The material of claim 1, wherein the number of foreign matters having a size of 40 μm or more on the support is substantially 0 per 75 square centimeter and the number of foreign matters having a size of from less than 40 μm to 10 μm on the support is 50 or less per 750 square centimeter.

11. The material of claim 1, wherein the support is firstly oriented by 2.7 to 5 times length at a temperature necessary to obtain an refractive index in a direction perpendicular to the first orientation in the plane of 1.597 or more, and then secondly oriented by 1.2 to 4.5 times length at a temperature of 70° C. to less than 105° C.

12. The material of claim 1, wherein the support has the following relation:

$Et^3 \geqq 340$ wherein E represents Young's modulus ($kgf/mm^2$) and t represents a thickness (μm) of the support.

13. The material of claim 1, wherein the support has a center line average roughness ($R_a$) of 0.008 μm or less and has a haze of 1.2% or less.

* * * * *